US007321103B2

(12) United States Patent
Nakanishi et al.

(10) Patent No.: US 7,321,103 B2
(45) Date of Patent: Jan. 22, 2008

(54) KEY SHEET AND MANUFACTURING METHOD FOR KEY SHEET

(75) Inventors: Yutaka Nakanishi, Tokyo (JP); Daisuke Machida, Tamakawa-mura (JP); Wataru Araki, Tamakawa-mura (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 11/512,107

(22) Filed: Aug. 30, 2006

(65) Prior Publication Data

US 2007/0045095 A1 Mar. 1, 2007

(30) Foreign Application Priority Data

Sep. 1, 2005 (JP) ..... 2005-254216

(51) Int. Cl.
*H01H 13/70* (2006.01)

(52) U.S. Cl. ..... 200/512; 200/341; 29/622; 428/139; 379/433

(58) Field of Classification Search ..... 200/512, 200/516, 341, 345; 428/68, 71, 76, 139, 428/166, 178, 189, 64.7; 341/22; 29/622; 156/230, 233–241, 273.5; 345/168, 169; 379/368, 433.06, 433.07, 422
See application file for complete search history.

(56) References Cited

U.S. PATENT DOCUMENTS

| | | | | |
|---|---|---|---|---|
| 5,613,599 | A * | 3/1997 | Inagaki et al. | 200/512 |
| 6,196,738 | B1 * | 3/2001 | Shimizu et al. | 400/490 |
| 6,380,681 | B1 * | 4/2002 | Matsuda et al. | 315/3 |
| 6,762,381 | B2 * | 7/2004 | Kunthady et al. | 200/512 |
| 6,770,212 | B2 * | 8/2004 | Hayashizaki | 216/28 |
| 7,034,235 | B2 | 4/2006 | Hosaka | |
| 7,094,985 | B2 * | 8/2006 | Kobayashi et al. | 200/516 |
| 7,099,465 | B2 * | 8/2006 | Nishi | 379/433.07 |
| 7,101,603 | B2 * | 9/2006 | Okamura et al. | 428/139 |
| 2004/0200712 | A1 | 10/2004 | Nishimura et al. | |

FOREIGN PATENT DOCUMENTS

JP 2005-063795 3/2005

* cited by examiner

*Primary Examiner*—Michael A Friedhofer
(74) *Attorney, Agent, or Firm*—Rader, Fishman & Grauer PLLC

(57) ABSTRACT

As a key sheet for fixing a base sheet and key tops to be arranged on the base sheet using adhesive layers, a key sheet where the key tops and the base sheet are fixed, is obtained by forming printed adhesive layers of the key tops on facing surfaces of at least either of the key tops or the base sheet by means of printing, and then bringing the printed adhesive layer into contact with the other facing surfaces in a softened or molten state, and by curing the printed adhesive layer.

26 Claims, 14 Drawing Sheets

KEY SHEET AND MANUFACTURING METHOD FOR KEY SHEET

BACKGROUND OF THE INVENTION

1. Field of the Invention

The present invention relates to a key sheet used for an operating part of various kinds of equipment such as a mobile-phone, a PDA, a car navigation system, and a car audio system, and a manufacturing method thereof.

2. Description of the Related Art

In a mobile-phone (1) shown in FIG. 15, a key sheet (11) shown in FIG. 16 is used. The key sheet (11) is a base sheet (12) made of silicone gum on which a plurality of, total 21 pieces of, key tops (13) made of a hard resin is fixed by dropping an UV adhesive or the like. When a key top (13) is pushed, the base sheet (12) is bend, thereby a contact electrode on a circuit board (not shown) located on the bottom surface of the key sheet is pushed to be a state of switch input, and when pushing is removed, the key top (13) is returned to its initial position by the restoring force of the base sheet (12), and the state of switch input is released.

Meanwhile, recently, as shown in FIG. 17, a mobile-phone (2) is also used, where an operating opening (2*a*) with no partitioning crosspiece (1*b*) (FIG. 15) between key tops (23) is opened, and from the opening, a key sheet (21) shown in FIG. 18, is exposed, where key tops (23) are arranged with a narrower gap between key tops (23). Since the mobile-phone (2) has no partitioning crosspiece (1*b*) (FIG. 15), in the key sheet (21), it is required to support the entire mobile-phone (2) only by the surrounding of the key sheet (21). Consequently, the base (22) is not made of rubber-like elastic body (22*a*) only, rather, as shown in FIG. 19, it has a construction where reinforcement (22*b*) such as hard resin and fiber reinforcement is provided among the rubber-like elastic body (22*a*). Such a key sheet is described, for example, in Japanese unexamined Patent Application Publication No. 2005-63975.

However, since it is noticeable of the change of design with respect to the mobile-phone, as a result of consideration for a key sheet with more fresh design, as an improved version of the above-mentioned key sheets (11 and 21), the inventors of the present invention devised a key sheet that is designed to have a frame corresponding to the partitioning crosspiece for partitioning each key top, and where a plurality of key tops and also the frame itself are exposed from an operating opening with no partitioning crosspiece of the mobile-phone. However, it was known that the improved version key sheet cannot be manufactured by modifying the structure of the conventional key sheets (11, 21), or by means of its manufacturing method.

In order to manufacture the conventional key sheets (11 and 21), a liquid adhesive such as an UV curing adhesive has been coated on the bottom surfaces of resin key tops (13 and 23), and the key tops (13 and 23) have been adhered to the base sheets (12 and 22). In this method, in order to prevent the adhesive from protruding from the key tops (13 and 23), only the center parts of the bottom surfaces of the key tops (13 and 23) have been coated with the adhesive. Consequently, the bottom surfaces of the key tops (13 and 23) have been coated with the adhesive not entirely, and gaps have occurred between the key tops (13 and 23) and the base sheets (12 and 22). It is the presence of the gaps that causes a problem of coming off of key tops.

In other words, as for the gaps, in the conventional key sheet (11), since a flange is formed around the key tops (13), and the mobile-phone (1) to be mounted has the partitioning crosspiece (1*b*), the coming off of the key tops (13) is substantially acceptable. However, since, in the key sheet (21) where key tops (23) are arranged with a narrower gap between key tops (23 and 23), the housing of the equipment has no partitioning crosspiece, and also the flange is not formed, there is a possibility for a nail for pushing operation to enter the gaps between the key tops (23) and the base sheet fixing the key tops (23), resulting in the possibility that the key tops (23) come off from the key sheet (21).

Moreover, in the improved version key sheet where gaps between key tops are wider, and the frame is exposed, since the possibility for a nail to enter the gaps between the key tops and the base sheet becomes higher than that of the key sheet (21) where key tops (23) are arranged with narrower gaps, the coming off of the key tops causes larger problems.

SUMMARY OF THE INVENTION

The present invention is provided on the back of the prior art technology and the development trend as above. In other words, the object of the present invention is to obtain a key sheet where fixing members of key tops or the like are firmly fixed to a base sheet. Moreover, another object of the present invention is to obtain a key sheet that has a practical use, an excellent designability, and a novel form.

The further object of the present invention is to obtain a manufacturing method for a key sheet that can adhere predetermined parts of key tops or the like to be fixed to the base sheet, precisely and surely.

In order to achieve the above-mentioned objects, a key sheet including a base sheet made of a resin film, key tops to be arranged on the base sheet, and printed adhesive layers of the key tops made of cured bodies that are formed on either of the key tops or the base sheet as printed layers, and brought into contact with the key tops and the base sheet in a softened or molten state.

Since, being provided with a base sheet made of a resin film, key tops to be arranged on the base sheet, and printed adhesive layers of the key tops made of cured bodies that are formed on either of the key tops or the base sheet as printed layers, and brought into contact with the key tops and the base sheet in a softened or molten state, the key sheet can have printed adhesive layers where the positions to be fixed and the thicknesses of coated films of the key tops and the base sheet, are precisely controlled. In other words, a key sheet where fluctuations of the positions and areas of the adhesive layers are smaller and the key tops are fixed to the base sheet more firmly than those of the conventional case where adhesion is performed by dropping adhesion on the bottom surfaces of the key tops, can be made.

As for a prior art adhesive layers, after being dropped on the bottom surfaces on key tops, for example, the adhesive is cured with being flown and spread laterally by a pushing force against the base sheet, that is, with its adhered areas being enlarged. For example, when the bottom surfaces are coated entirely, the adhesive is flown and spread largely and laterally by the pushing force against the base sheet, and cured with its adhered areas being protruded from the bottom surfaces of the key tops. Moreover, for example, when parts of bottom surfaces are coated, the adhesive is flown and spread largely and laterally by the pushing force against the base sheet, and cured with its adhered areas being enlarged.

However, the printed adhesive layers of the present invention, are brought into contact with the key tops and the base sheet "in a softened or molten state". Specifically, the adhesive layers are brought into contact with the key tops and the base sheet in a softened or molten state after being printed before they cure. Accordingly, it is possible to suppress that the printed adhesive layers of the present invention, flow and spread laterally and largely as those of in a prior art.

For, example, when being printed on the entire bottom surfaces of the key tops, the printed adhesive layer are cured without being protruded from the bottom surfaces, and with areas substantially equal to the areas of bottom surfaces. Consequently, the printed adhesive layers of the present invention do not bind the flexible part of the base sheet that floats and supports the key tops so as to enable their displacement by pushing. Accordingly, by using the printed adhesive layer of the present invention, it is possible to consist both of adhering entire surfaces or specific areas of the key tops, and the operability of pushing of the key tops.

Further, since the base sheet is a resin film, a key sheet that is thinner and less flexible than a base sheet made of a lubber-like elastic body, can be made. Consequently, it is a fresh key sheet where a plurality of key tops and frame parts between key tops are exposed from a large operating opening provided to the equipment, and a practical key sheet where distortion of the base sheet hardly occurs.

The above-mentioned key sheet can be constituted to be a key sheet that includes a frame sheet to be arranged on the base sheet together with the key tops. If the key sheet including a frame sheet to be arranged on the base sheet together with the key tops, is used, it is possible for the nail tip to hardly enter the gaps between key tops and the base sheet, further it is possible for the key sheet to hardly come off their key tops. Moreover, it is possible for the key sheet to have a structure where extreme floating of the key tops is prevented, thereby, coming off of the key tops hardly occur. Further, by being reinforced its strength, it is possible for the key sheet to keep its entire formability and to have a fresh design.

In addition, the frame sheet is a member for filling the gaps formed on the sides of the key tops, it becomes as a partitioning crosspiece between the key tops, and becomes as a frame between the operating opening and the key tops of the housing etc. of the equipment. Consequently, for example, an object that is used only as the partitioning crosspiece between the key tops, also an object that is used only as the frame between the operating opening and the key tops, are included as a frame sheet, and an object that covers the base sheet entirely at its parts other than key tops, is also included as a frame sheet.

Moreover, the present invention can be a key sheet that includes adhesive layers for fixing the frame sheet and the base sheet, where the printed adhesive layers of key tops are formed on the entire bottom surfaces of the key tops, and the adhesive layer of the frame sheet is formed on the bottom surface of the frame sheet except for the outer edge sides neighboring the key tops. Since the printed adhesive layers of the key tops are formed on the entire bottom surfaces of the key tops, a key sheet can be obtained, where gaps between the key tops and the base sheet do not occur, and coming off of the key tops hardly occurs. Moreover, since the adhesive layers are provided on the entire bottom surface of the key tops, there is no fluctuation between a part that has the adhesive layer and a part that has no adhesive layer, enabling the pushing operation to the key to be lead to a correct switch input, thereby it is a key sheet with good operability. Further, when so called illuminated key tops are used, since the adhesive layers are provided on the entire bottom surfaces of the key tops, a key sheet that has no illumination unevenness and enabling homogeneous illumination, can be made.

Additionally, since the adhesive layer is provided on the bottom surface of the frame sheet except for the outer edge sides neighboring the key tops, gap parts with no adhesive layer occurs at the outer edge sides neighboring the key tops of the frame sheet, and the parts become non non-binding regions. Additionally, by being provided with the non-binding regions, it is possible to perform pushing operation of the key tops surely. In other words, since the non-binding regions are present around the key tops, in the base sheet for supporting the key tops, the regions that are not bound by the adhesive layers are spread by an amount of gap parts, thereby, resulting in the flexibility of the base sheet. Consequently, it is possible to cause the pushing stroke of the key tops to be longer, resulting in a key sheet that enables correct operation of key input. In addition, even if gaps have occurred in the frame sheet, the frame sheet can be fixed to the base sheet by its wider parts, thereby a problem of coming off of the frame sheet is substantially acceptable.

The adhesive layer of the frame sheet can be a printed adhesive layer made of a cured body that formed on either of the frame sheet or the base sheet as a printed layer, and brought into contact with the frame sheet and the base sheet in a softened or molten state. Since the adhesive layer of the frame sheet is formed on either of the frame sheet or the base sheet as a printed layer, and caused to be a printed adhesive layer made of a cured body that formed on either of the frame sheet or the base sheet as a printed layer, and brought into contact with the frame sheet and the base sheet in a softened or molten state, it is possible for the adhesive layer to be formed on a predetermined part on the bottom surface of the frame sheet. Consequently, parts to be fixed and parts to be not fixed of the frame sheet and the base sheet can be controlled with high degree of accuracy.

The present invention can also provide a key sheet that includes neighboring key tops arranged on the base sheet together with the key tops, and adhesive layers for fixing the neighboring key tops and the base sheet, where the printed adhesive layers are formed on the entire bottom surfaces of the key tops, and the adhesive layers of the neighboring key tops are formed on the bottom surfaces of the neighboring key tops except for their outer edge sides neighboring the key tops.

Since the neighboring key tops to be arranged on the base sheet together with the key tops, are provided, and the printed adhesive layers of the key tops are formed on the entire bottom surfaces of the key tops, a key sheet can be obtained, where gaps do not occur between the key tops and the base sheet, and thereby coming off of the key tops hardly occur. Moreover, since the adhesive layers are provided on the entire bottom surfaces of the key tops, there is no fluctuation between a part that has the adhesive layer and a part that has no adhesive layer, enabling the pushing operation to the key tops to be lead to a correct switch input, thereby it is a key sheet with good operability. Further, when so called illuminated key tops are used, since the adhesive layers are provided on the entire bottom surfaces of the key tops, a key sheet that has no illumination unevenness and enabling homogeneous illumination, can be made.

Additionally, since the adhesive layers are provided on the bottom surfaces of the neighboring key tops except for the outer edge sides neighboring the key tops, gap parts with no adhesive layer occur at the outer edge sides, of the neighboring key tops, neighboring the key tops, and the parts become non-binding regions. Additionally, by being provided with the non-binding regions, it is possible to perform pushing operations of the key tops surely. In other words, as the regions of the base sheet that are not fixed to the neighboring key tops increases around the key tops, the base sheet becomes more flexible. Consequently, it is possible to cause the pushing stroke of the key tops to be longer, enabling correct operation of key input.

As for the relationship between the key tops and the neighboring key tops, the neighboring key tops can be made larger than the key tops. As an example like this, for example, the relationship between a center key top enabling at least pushing operation and ring key tops surrounding the center key top, is included. Even if gaps occur on the ring key tops, i.e. neighboring key tops, since sizes of the ring key tops are large, it is possible to fix the ring key tops to the base sheet at their wide parts, thereby, coming off of the ring key tops is substantially acceptable.

The adhesive layers of the neighboring key tops can be printed adhesive layers made of cured bodies formed on either of the neighboring key tops or the base sheet as printed layers and brought into contact with the key tops and the base sheet in a softened or molten state. Since the adhesive layers of the neighboring key tops are caused to be the printed adhesive layers made of cured bodies formed on either of the neighboring key tops or the base sheet as printed layers and brought into contact with the key tops and the base sheet in a softened or molten state, it is possible to form the printed adhesive layers on predetermined parts of the bottom surfaces of the neighboring key tops correctly, enabling controlling parts to be fixed and parts to be not fixed of the neighboring key tops and the base sheet with high degree of accuracy.

Further, the present invention provides a key sheet that includes a base sheet made of a resin film, key tops arranged on the base sheet, printed adhesive layers whose sides substantially flush with the sides of the key tops are formed between the base sheet and the key tops, to fix the base sheet and the key tops.

Since, the key sheet that includes the base sheet made of a resin film, the key tops arranged on the base sheet, the printed adhesive layers whose sides substantially flush with the sides of the key tops are formed between the base sheet and the key tops, to fix the base sheet and the key tops, is used, it is a key sheet where there is no gap at the boundary between the key tops and the base sheet, and key tops firmly fixed to the base sheet. Accordingly, as compared to the case of the conventional key sheet that adhered to the base sheet by dropping a liquid adhesive on the bottom surfaces of the key tops, where adhesive layers are provided only parts of the bottom surfaces of the key tops, and gaps occurred at the boundaries between the key tops and the base sheet, it is a key sheet where a problem of hooking of nail tip or the like is acceptable, and coming off of the key tops hardly occur. In addition, in the key sheet, "substantially flush with" means that the sides of the printed adhesive layers are in a state of irregularity of ±0.5 mm or less with respect to the sides of the key tops.

The above-mentioned key sheet can be constituted as a key sheet that is provided with a frame sheet arranged on the base sheet together with the key tops. Since being provided with a frame sheet arranged on the base sheet together with the key tops, it is a key sheet where coming off of the key tops hardly occur, because as compared to the case with no frame sheet, the tip of nail hardly enters the gaps between the key tops and the base sheet, and extreme floating up of the key tops can be prevented. Moreover, its design is also fresh, and further the strength of the base sheet is reinforced, thereby, a key sheet whose entirety hardly bend with being mounted on the equipment can be made.

The above-mentioned key sheet can be a key sheet that is provided with an adhesive layer for fixing the frame sheet and the base sheet, where the printed adhesive layers of the key tops are formed on the entire bottom surfaces of the key tops, and the adhesive layer of the frame sheet is formed on the bottom surface of the frame sheet except for the outer edge sides neighboring the key tops. Since the printed adhesive layers of the key tops are formed on the entire bottom surfaces of the key tops with being substantially flush with the sides of the key tops, the key tops are firmly fixed to the base sheet without the occurrence of gap between the key tops and the base sheet. Consequently, it is a key sheet where coming off of the key tops hardly occurs. Moreover, since being provided with the adhesive layer on the entire bottom surfaces of the key tops, the key sheet can lead the pushing operation to the key top to a correct switch input. Further, when so called illuminated key tops are used, since the adhesive layers are provided on the entire bottom surfaces of the key tops, it is a key sheet that has no illumination unevenness and enables homogeneous illumination.

Additionally, since the adhesive layer of the frame sheet is one formed on the bottom surface of the frame sheet except for the outer edge sides neighboring the key tops of the frame sheet, gap parts with no adhesive layer occur at the outer edge sides of the frame sheet between the frame sheet and the key tops, and the parts become non-binding regions. Additionally, by being provided with the non-binding regions, it is possible to perform the sure pushing operation of the key top. In other words, the base sheet becomes more flexible by an increased amount of the regions where the base sheet is not fixed with the neighboring key tops. Consequently, it is possible to cause the pushing stroke of the key top to be longer, enabling correct operation of the key input. In addition, even if gaps occurred on the frame sheet, since the frame sheet can be fixed to the base sheet using the wide part of the frame sheet, the degree of the coming off of the frame sheet is substantially acceptable.

Moreover, the adhesive layer of the frame sheet can be caused to be a printed adhesive layer. Since the adhesive layer of the frame sheet is caused to be the printed adhesive layer, the key sheet can have a printed adhesive layer formed correctly on a predetermined part of the bottom surface of the frame sheet, thereby, can be a key sheet where parts to be fixed and parts to be not fixed of the frame sheet and the base sheet can be controlled with high degree of accuracy.

Further, the key sheet according to the present invention, is provided with neighboring key tops arranged on the base sheet together with the key tops, and adhesive layers for fixing the neighboring key tops and the base sheet, the printed adhesive layers of the key tops can be printed adhesive layers formed on the entire bottom surfaces of the key top, and the adhesive layers of the neighboring key tops can be adhesive layers that are formed on the bottom surfaces of the neighboring key tops except for the outer edge sides neighboring the key top.

Since the printed adhesive layers of the key tops are formed on the entire bottom surfaces of the key tops, gaps do not occur between the key tops and the base sheet, enabling to obtain a key sheet where coming off of the key tops hardly occurs. Since the printed adhesive layers of the key tops are provided on the entire bottom surfaces of the key tops, there is no fluctuation between a part with an adhesive layer and a part without an adhesive layer, thereby, the key sheet can lead the pushing operation to the key top to a correct switch input. Further, when so called illuminated key tops are used, since the adhesive layers are provided on the entire bottom surfaces, it is a key sheet that has no illumination unevenness and enables homogeneous illumination.

Moreover, since the key sheet is provided with neighboring key tops arranged on the base sheet together with the key tops, and adhesive layers for fixing the neighboring key tops and the base sheet, and the adhesive layers of the neighboring key tops are formed on the bottom surfaces of the neighboring key tops except for the outer edge sides neighboring the key tops, it is possible to cause gap parts with no adhesive layer at the outer edge sides of the neighboring key tops with respect to the key tops, and the parts become non-binding regions. Additionally, by being provided with the non-binding region, it is possible to perform the sure pushing operation of the key top. In other words, since the non-binding regions are present around the key tops, regions that are not bound by the adhesive layers spread, causing the base sheet to be easily flexible. In other words, the base sheet becomes more flexible by an increased amount of the regions where the base sheet is not fixed to the neighboring key tops. Consequently, it is possible to cause the pushing stroke of the key top to be longer, enabling correct operation of the key input.

As for the relationship between the key tops and the neighboring key tops, the neighboring key tops can be larger than the key tops. As an example like this, for example, the relationship between a center key top enabling at least pushing operation and ring key tops surrounding the center key top, is included. Even if gaps occur on the ring key tops, i.e. neighboring key tops, since sizes of the ring key tops are large, it is possible for the key tops to be fixed to the base sheet at their wide parts, coming off of the ring key tops is substantially acceptable.

Moreover, the adhesive layers of the neighboring key tops can be caused to be a printed adhesive layer. Since the adhesive layers of the neighboring key tops are caused to be printed adhesive layers, it is possible to have printed adhesive layers formed on predetermined parts of the bottom surfaces of the neighboring key tops, enabling to cause the key sheet to be a key sheet where a part to be fixed and a part to be not fixed between neighboring key tops and the base sheet can be controlled with high degree of accuracy.

The above-mentioned key sheet can be a key sheet on which a flush operation surface is formed, where the key tops and the frame sheet or the neighboring key tops are substantially continuing. Since the key sheet is caused to be a key sheet on which a flush operation surface is formed, where the key top and the frame sheet or the neighboring key top are substantially continuing, it is a key sheet where the neighboring key tops are hardly pushed laterally, and coming off of these parts hardly occurs.

Other than the invention with regard to above-mentioned key sheet, the following invention relating to a manufacturing method for the key sheet will be provided. In other words, the present invention is a manufacturing method for a key sheet where a base sheet and key tops arranged on the base sheet are fixed by adhesive layers, wherein the key tops and the base sheet are fixed by forming printed adhesive layers of the key tops on facing surfaces of at least either of the key tops or the base sheet, by means of printing, and bringing the printed adhesive layers into contact with the other facing surfaces of the key top or the base sheet in a softened or molten state, and curing the printed adhesive layer.

Since the printed adhesive layers of the key tops are formed on facing surfaces of at least either of the key tops or the base sheet, by means of printing, the printing surfaces can be arbitrarily determined by considering the sizes, materials, and adhering points of the key tops and the base sheet. Moreover, since the printed adhesive layers are formed by means of printing, by controlling the printing parts to fixing positions of the key tops and the base sheet, and quantity to be coated with high accuracy, printed adhesive layers can be formed. The printed adhesive layers can be adhered by means of heating and pressing in a softened or molten state, after being caused to be in a solid state after printing, or the adhesive layers can also be adhered in a softened or molted state of printed ink, after printing and before curing. Especially, when the adhesive layer is caused to be in a solid state after printing and before adhering, sagging of the ink can be suppressed, enabling high accuracy control of the adhering position. Moreover, since positioning can be performed by bringing the key tops and the base sheet into contact with each other, the positioning operation is easy, and the flowage of the adhesive layer during positioning or during pressing can be suppressed. Further, there is such an advantage that during heating and during pressing in a post-process, by selecting parts to be heated and to be pressed, the adhering positions can be adjusted. In addition, since the adhesive layers are cured by being brought into contact with the others in a softened or molten state, it is possible for the printed adhesive layers to be suppressed their volume change, and adhered at desired positions with high accuracy.

Accordingly, when compared to a conventional method, for example, a method where adhesion is performed by dropping an adhesive on the bottom surface of the key tops, it is possible to control the parts to be coated with the adhesive, the quantity to be coated of the adhesive, and the shapes of the provided adhesive layers, correctly. In other words, a problem in that, when the adhesive dropped to fix the key tops and the base sheet in a state still being liquid, there is much fluctuation of dropped positions and the areas of the fixed parts after coming off also tend to change, can be eliminated.

Further, since the base sheet is a resin film, when the printed layer is formed, the printing is easy, and when the printed adhesive layer is fixed the base sheet by heating the base sheet and pressing the base sheet, heat transfer during heating the base sheet and pressure transfer during pressing the base sheet, are performed adequately. Moreover, deformation and alteration of the base sheet hardly occur, thereby, the manufacturing of the key sheet is easy.

Moreover, the present invention is a manufacturing method for a key sheet provided with a base sheet, key tops arranged on the base sheet, and a frame sheet arranged on the base sheet together with the key tops, wherein the key tops are fixed to the base sheet by forming printed adhesive layers of the key tops on entire facing surfaces of at least either of the key tops or the base sheet, by means of printing, and bringing the printed adhesive layer into contact with the other facing surfaces of the key top or the base sheet in a softened or molten state, and curing the printed adhesive layers, and the entire bottom surfaces of the frame sheet except for the outer edge sides neighboring the key tops are fixed to the base sheet.

Since the key tops are fixed to the base sheet by forming printed adhesive layers of the key tops on entire facing surfaces of at least either of the key top or the base sheet, by means of printing, and bringing the printed adhesive layers into contact with the other facing surfaces of the key tops or the base sheet in a softened or molten state, and curing the printed adhesive layers, a key sheet where gaps do not occur between the key tops and the base sheet, and coming off of the key top hardly occur, can be obtained. In addition, since the bottom surface of the frame sheet except for the outer edge sides neighboring the key tops, gap parts that have no adhesive layer, and predetermined sizes and shapes, can occur on the outer edge sides of the frame sheet with respect to the key tops. Consequently, a key sheet that enables pushing operation of the key top, can be obtained.

Furthermore, the present invention provides a manufacturing method for a key sheet provided with a base sheet, key tops arranged on the base sheet, and neighboring key tops arranged on the base sheet together with the key tops, wherein the key tops are fixed to the base sheet by forming printed adhesive layers of the key tops on entire facing surfaces of at least either of the key top or the base sheet, by means of printing, and bringing the printed adhesive layers into contact with the other facing surfaces of the key top or the base sheet in a softened or molten state, and then curing the printed adhesive layer, and the bottom surfaces of the neighboring key tops except for the outer edge sides neighboring the key tops are fixed to the base sheet.

Since the key tops are fixed to the base sheet by forming printed adhesive layers of the key tops on entire facing surfaces of at least either of the key top or the base sheet, by means of printing, and bringing the printed adhesive layers into contact with the other facing surfaces of the key tops or the base sheet in a softened or molten state, and curing the printed adhesive layers, a key sheet where gaps do not occur between the key tops and the base sheet, and coming off of the key top hardly occur, can be obtained. In addition, since the bottom surfaces of the neighboring key tops except for the outer edge sides neighboring the key tops, gap parts that have no adhesive layer, and predetermined sizes and shapes, can occur on the outer edge sides of the neighboring key tops with respect to the key tops. Consequently, a key sheet that enables pushing operation of the key top, can be obtained.

In order to cause the printed adhesive layer to be in a softened or molten state, adhesive layers of the key tops, whose entire surfaces or parts of the surfaces are caused to be heated, can be used. Since the entire surfaces or parts of the surfaces of the printed adhesive layers of the key tops are caused to be heated, as for printed adhesive layers in a solid state without being adhered to bodies to be adhered, they can be caused to be in a state enabling adherence to the bodies to be adhered. Moreover, even after the printed adhesive layers are provided, the parts to be fixed practically can be adjusted. For example, by heating parts of the frame sheet while previously by forming adhesive layers on the entire bottom surface of the frame sheet, it is possible to cause the parts to be not heated of the frame sheet to be non-binding regions where the base sheet and the frame sheet is not fixed. This enables adjustment such as widening of the non-binding regions, if, for example, the base sheet is a material that hardly bends depending on its quality or its thickness.

Moreover, in order to control the adhered parts between the key tops or the frame sheet etc. and the base sheet, regardless the presence or non-presence of the printed adhesive layers, it is possible for the parts to be non-binding regions to which these are not adhered, to be provided with masking layers, preliminarily.

In a step of printing for forming the printed adhesive layers, a solvent-diluted ink can be used. Since the solvent-diluted ink is used, it is possible to perform printing and coating using such a resin that melts or softens by being heated, as a solvent-diluted ink. Consequently, it is possible to provide the adhesive layers at adequate positions and at adequate quantity. Moreover, when a solvent is vaporized in the solvent-diluted ink, printed layers are formed in a solid state. Consequently, as compared to the case when a liquid adhesive is used, it is easy to control the degree of spread of the adhesive layers. Consequently, it is possible to provide the printed adhesive layers at desired positions.

According to the key sheet of the present invention, the key sheet can be caused to be a key sheet that has key tops and frame sheet on a base sheet made of a resin film. In addition, it is caused to be a thin key sheet where, in addition a problem such as the occurrence of distortion of the base sheet or the coming off of the key top hardly occurs, pushing operation of the key tops can be adequately performed, and a design in a housing of equipment such as a mobile-phone that exposes not only the key tops but also the frame sheet from an operating opening with no partitioning crosspiece, is realized.

Moreover, according to the manufacturing method for a key sheet of the present invention, it is possible to adhere the key tops, the frame sheet, and the neighboring key tops to the base sheet at desired positions on the key sheet made of a resin film, and it is possible to obtain a key sheet where bonding strength with respect to the key tops or the like is high, and coming off of the key top or the like hardly occurs. Moreover, it is possible to obtain a key sheet where pushing operation of the key tops can be adequately performed.

The present invention is not limited to the description as described above. An advantage, characteristics, and an application of the present invention are made further clear by the following embodiments described with reference to the drawings. Further, it should be understood that the scope of the present invention includes all appropriate modifications without departing from the spirit of the present invention.

BRIEF DESCRIPTION OF THE DRAWINGS

In the appended drawings,

FIG. 13A shows key sheet having the gap parts, and FIG. 13B shows key sheet not having the gap parts.

DESCRIPTION OF THE PREFERRED EMBODIMENTS

Figure 1:
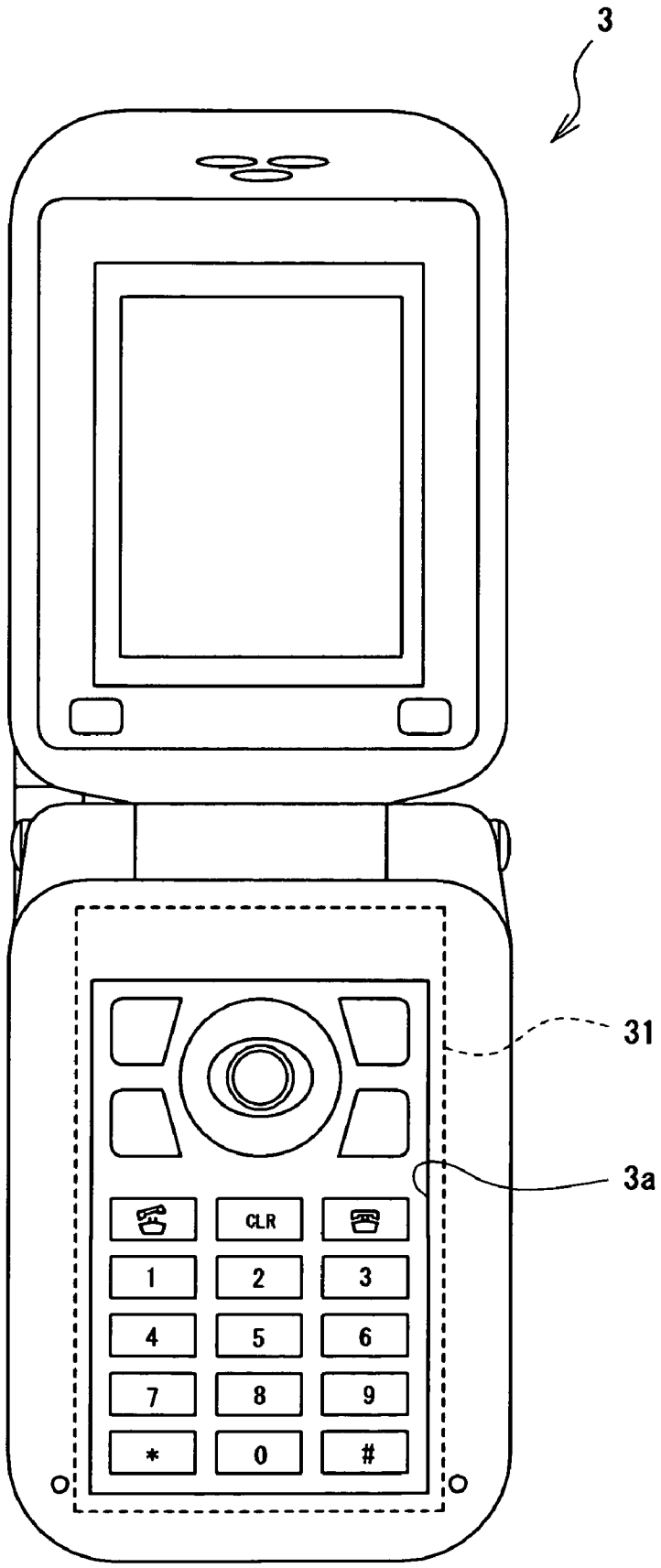
FIG. 1 is a schematic view of a mobile-phone on which a key sheet according to a first embodiment, shown in FIG. 2, is mounted.
Figure 2:
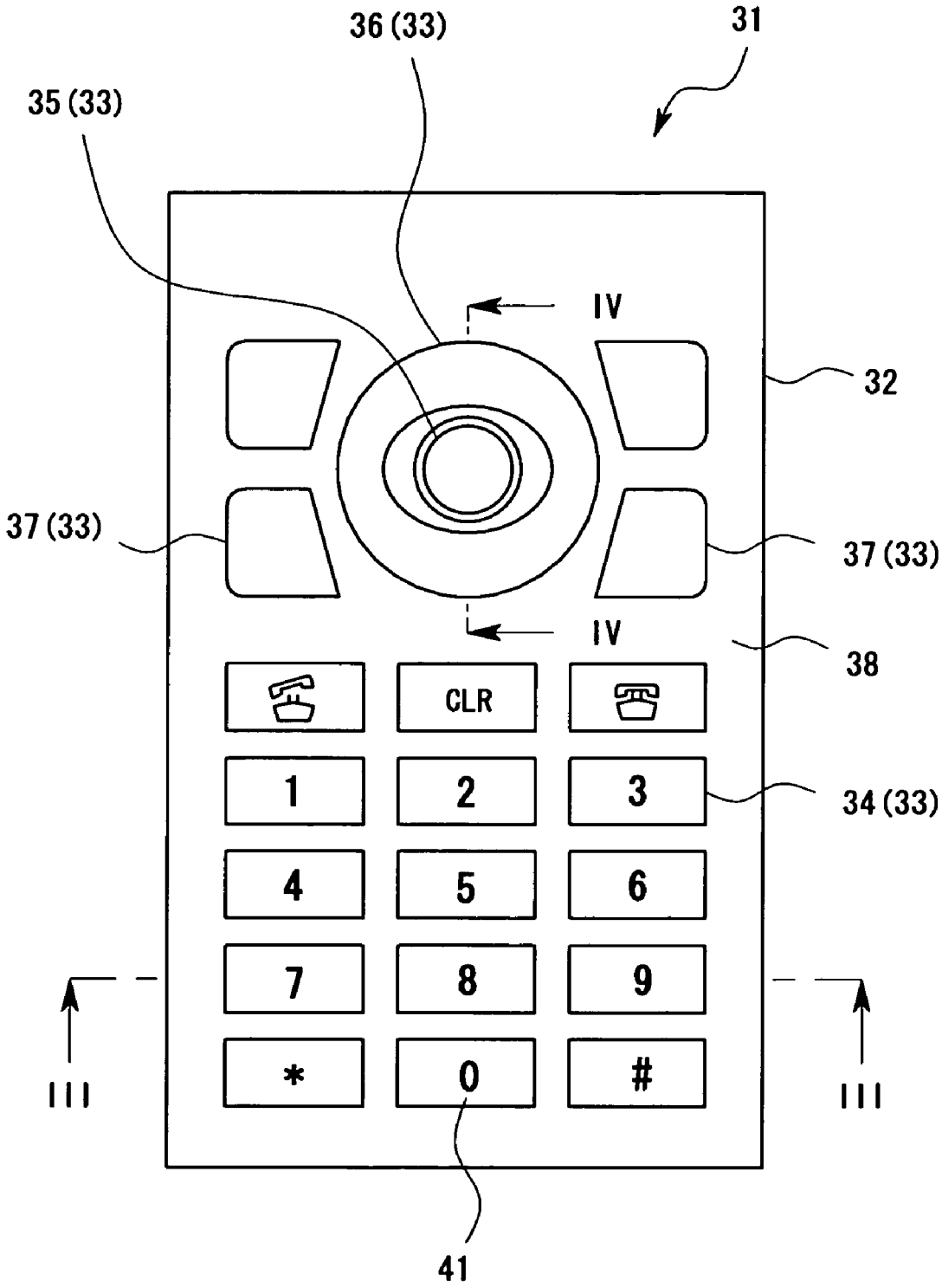
FIG. 2 is a plane view of the key sheet according to the first embodiment.

Hereinafter, referring to the drawings, the present invention will be described based on its embodiments. Throughout the drawings, reference numerals are intended to designate parts or components. A key sheet (31) is a part that is used in a mobile-phone (3) shown in FIG. 1, so as to be exposed from a large operating opening (3*a*) of the mobile-phone (3), and has a planar shape shown in FIG. 2. In other words, the key sheet (32) is a part that is provided with a plurality of key tops (33), i.e. medium size key tops (34) arranged in five rows and three columns, a round center key top (35) provided on the upper side of the center of a key sheet, a ring key top (36) surrounding the center key top (35), and four longitudinal key tops (37) provided on the edges of the ring key top (36), and further a frame sheet (38) for partitioning these key tops (33, 34, 36, and 37), and as its section is shown in FIGS. 3 and 4, it is a key sheet where the key tops (33) and the frame sheet (38) are fixed to the base sheet (32) via printed adhesive layers (39).

Figure 3:
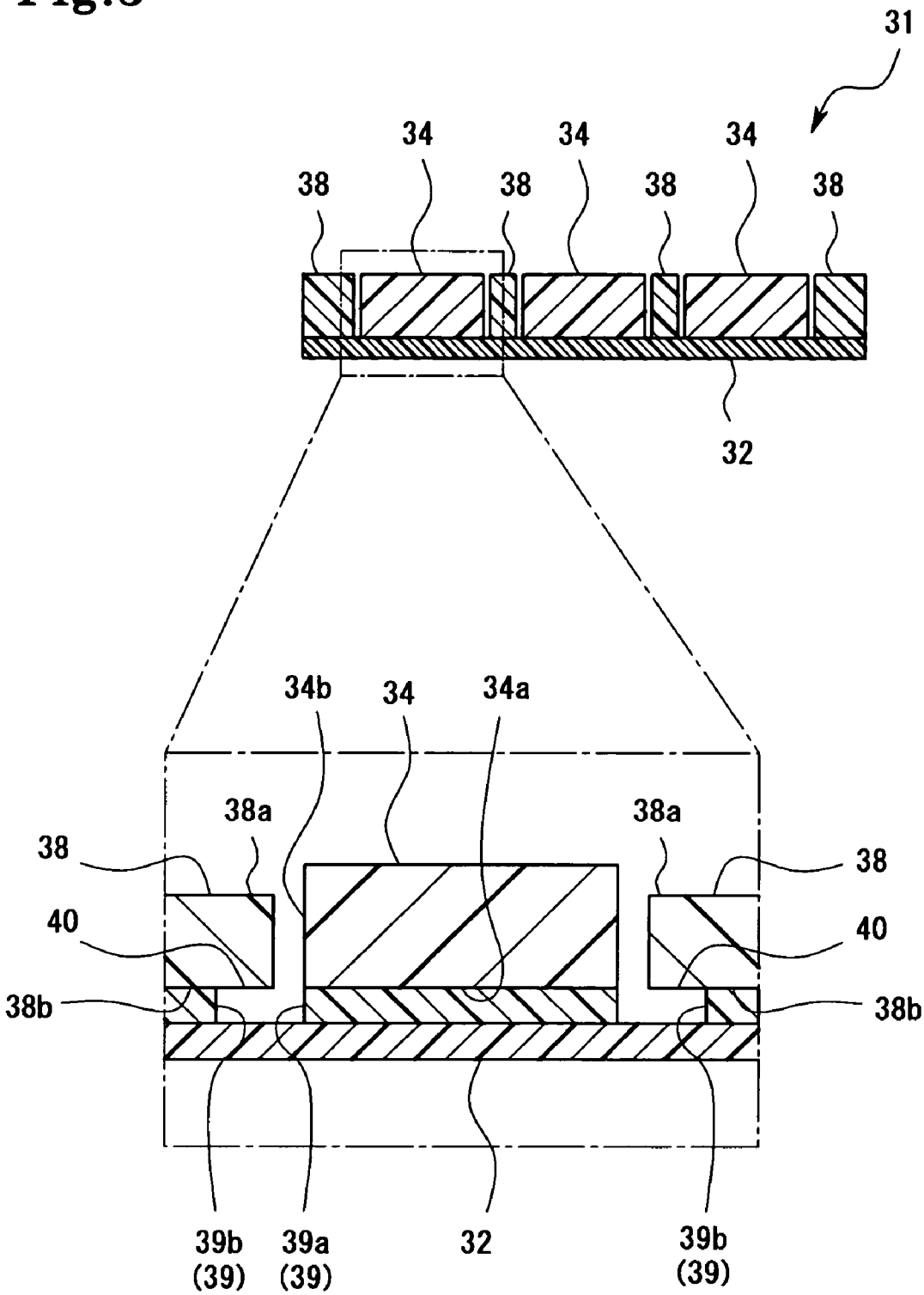
FIG. 3 is a sectional view of III-III line in FIG. 2.

As shown in FIG. 3, as for printed adhesive layers (39*a*) of the medium size key tops (34) that are present between the medium size key tops (34) and the base sheet (32), they are provided on the entire bottom surfaces of the medium size key tops (34), and formed along the sides (34*b*) of the medium size key tops (34) with being flush with the sides (34*b*) of the medium size key tops (34). Meanwhile, as for a printed adhesive layer (39*b*) provided between the frame sheet (38) and the base sheet (32), it is not provided to the outer edge sides (38*a*) of the frame sheet (38), neighboring the medium size key tops (34). Consequently, since, at the outer edges (38*a*) of the frame sheet (38), neighboring the medium size key tops (34), the printed adhesive layer (39) is not present, thereby, gap parts (40) where the frame sheet (38) and the base sheet (32) is not fixed occurs. Moreover, at the gap parts (40), the base sheet (32) becomes non-binding regions that are not bound by the frame sheet (38). Also, as for the adhesion between the longitudinal key tops (37) and the base sheet (32), similar to the adhesion between the medium size key tops (34) and the base sheet (32), the longitudinal key tops (37) are fixed to the base sheet (32) by providing printed adhesive layers (39*c*) on the entire bottom surfaces (37*a*) of the longitudinal key tops (37).

Figure 4:
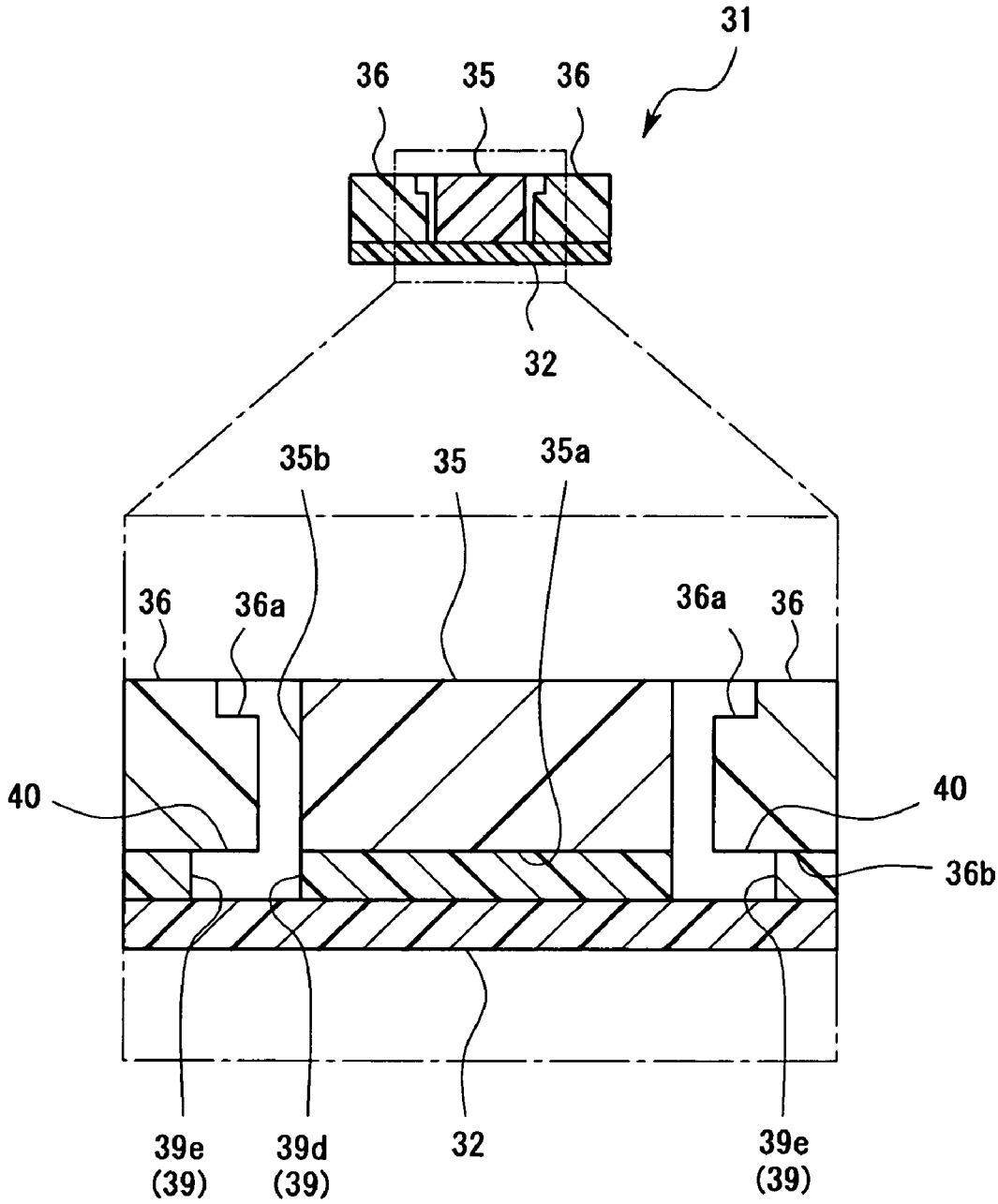
FIG. 4 is a sectional view of IV-IV line in FIG. 2.

Moreover, as shown in FIG. 4, also between the center key top (35) and the base sheet (32), a printed adhesive layer (39*d*) of the center key top (35) is provided on the entire bottom surface (35*a*) of the center key top (35), and forms its sides substantially flush with the sides (35*b*) of the center key top (35). Meanwhile, the ring key tops (36) to be neighboring key tops with respect to the center key top (35), between the ring key top (36) and the base sheet (32), a printed adhesive layer (39*e*) of the ring key top (36) is also provided, however, the printed adhesive layer (39*e*) is not provided to the outer edge (36*a*) parts of the ring key top (36) neighboring the center key top (35). Consequently, at the outer edge sides (36*a*) of the ring key top (36) neighboring the center key top (35), the printed adhesive layer (39*e*) is not present, thereby, the part becomes a non-binding region with a gap part (40) being occurred, where the ring key top (36) and the base sheet (32) are not fixed each other.

Although, a hard resin such as a thermosetting resin, or a thermoplastic resin, is used for each key top (33) of the medium size key tops (34), the center key top (35), the ring key top (36), and the longitudinal key tops (37), it is preferable to use a polycarbonate resin, an ABS resin, an acrylate resin, a polyester resin, a PBT resin, and an alloy-based resin of these resins. Moreover, on the key tops (33), display parts (41) expressing a letter, a symbol, a figure, or the like may be formed. As for the thicknesses of the key tops (33), from a demand of thinning, they are preferable to be an order of 0.2 mm to 0.6 mm, and as one embodiment, they can be formed to be an order of 0.4 mm.

The frame sheet (38) is a part that is provided from a reason such as to keep the shape of the key sheet (31) along with the base sheet (32), to protect the extreme floating up of the key tops (33), to hide the trace of forming, and to protect the adhered part between the key top (33) and the base sheet (32). As for the frame sheet (38), a resin film such as, for example, a polyethylene terephthalate film, a polybutylene terephthalate film, a polyurethane film, a polyamide film, a polypropylene film, a polystyrene film, a fluorine film, an ionomer film, a polycarbonate film, and a polyvinyl chloride film, can be used, and from a view point of decoration, the frame sheet (38) can be provided with a colored layer, or a vaporized layer. Moreover, when the key sheet is caused to be a so called illuminated key sheet (31) where the display part (41) such as a letter, or a symbol is illuminated by emitting light from a light source such as LED provided in the mobile-phone (2), it is possible to use a light shielding resin film or to provide a light shield layer such that leakage of light does not occur from the frame sheet (38). As for the thickness of the frame sheet (38), from a view point of harmony with respect to the heights of the key tops (33) it is preferable to be an order of 0.2 mm to 0.5 mm, and as one embodiment, it can be formed to be an order of 0.3 mm to 0.35 mm.

The base sheet (32) has a function to keep the shape of the key sheet (31), together with the frame sheet (38), and to be a base on which the key top (33) is placed, and further when the key top (33) is pushed, it has a function to push a contact point provided on a substrate (not shown) by being slightly distorted. As for the base sheet (32), a resin film such as, for example, a polyethylene terephthalate film, a polybutylene terephthalate film, a polyurethane film, a polyamide film, a polypropylene film, a polystyrene film, a fluorine film, an ionomer film, a polycarbonate film, and a polyvinyl chloride film, can be used. When the key sheet is caused to be the so called illuminated key sheet (31), it is possible to use an optically-transparent resin film. Further, a colored layer or an optical guide layer can be provided. As for the thickness of the base sheet (32), from a demand of thinning, it is preferable to be 150 μm or less, more preferably, to be 50 μm or less. As one embodiment, it can be formed to be an order of 50 μm. The surface of the base sheet (32) opposite to the surface having the key top (33) of the base sheet (32), can has a structure where a bulge like a pusher is provided to a part to push the contact electrode, depending on the form of a facing circuit board (not shown). When compared the base sheet (32) with respect to the frame sheet (38), both of them can be formed using a resin film, and their material can also be same, however, it is preferable for the thickness of the base sheet (32) to be thinner than that of the frame sheet (38).

The printed adhesive layers (39) are adhesive layers for adhering the key tops (33) or the frame sheet (38) and the base sheet (32), and are parts that are formed by means of printing. As for the ink for the printed adhesive layers (39), it is preferable to use a raw material that is softened or molten by being heated, for example, resin such as acryl-based one, vinyl chloride-based one, polyester-based one, urethane based one, wax, gum, or the like can be used. As for the form as an ink, it is an ink with a property that has fluidity enough to be printed during being coated, after that keeps to be in a solid state, thereby, an ink such as an solvent-diluted ink that is dissolved or dispersed in a solvent, or an liquid ink that is formed by hot-melting a solid material being in a solid state at normal temperature, can be used. However, from a view point of printability for being printed on predetermined bottom surfaces of the key tops (33) or the like, finely with high accuracy, or a view point to be in a solid state immediately after being printed, thereby the printed shape can be held, it is preferable to use a solvent-diluted ink. Among them, from a view point to suppress sagging and distortion of the printed adhesive layers (39), in a step of adhering by means of performing heating and pressing, it is preferable to use a material that is softened by being heated, rather a material that is molten by being heated.

In order to manufacture the key sheet (31), the following steps are performed. First, by means of die forming, the key tops (33), the base sheet (32), and the frame sheet (38), are formed from respective materials. Next, as required, a colored layer or vaporized layer (not shown), and the display parts (41) are formed. Then, the printed adhesive layers (39) are formed on the key tops (33) and the frame sheet (38) by means of screen printing, pad printing, relief printing, gravure printing, or the like. After that, by positioning the base sheet (32), the key tops (33) and the frame sheet (38), predetermined regions of the base sheet (32), the key tops (33) and the frame sheet (38) are heated and pressed from the base sheet (32) side, by a thermo-compression machine or the like, resulting in the adhesion between the base sheet (32) and the key tops (33), and between the key tops (33) and the frame sheet (38).

Figure 5:
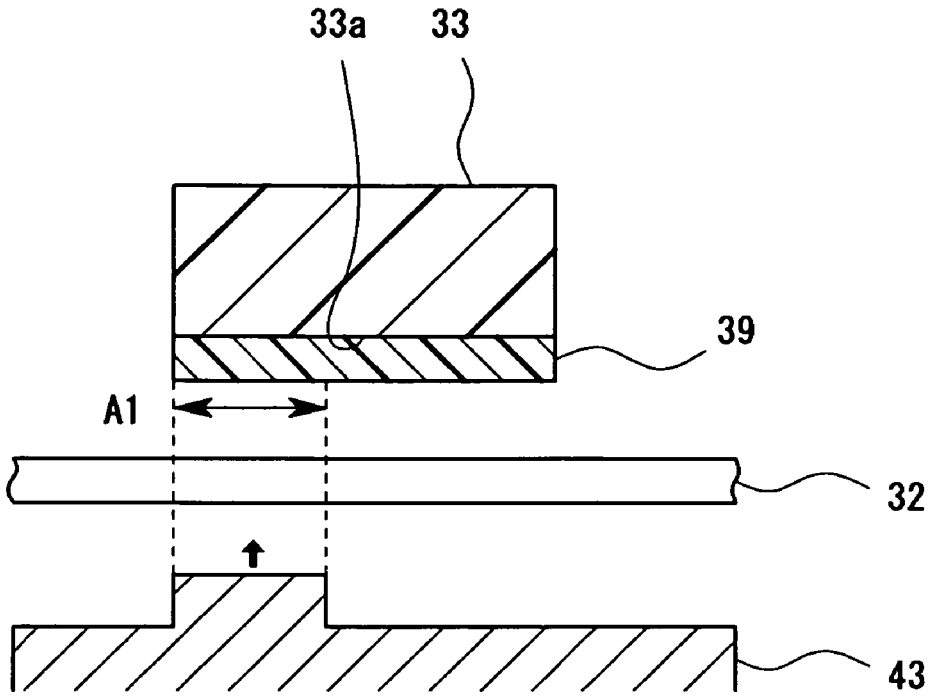
FIG. 5 is an illustrative view of one manufacturing step of a key sheet.
Figure 6:
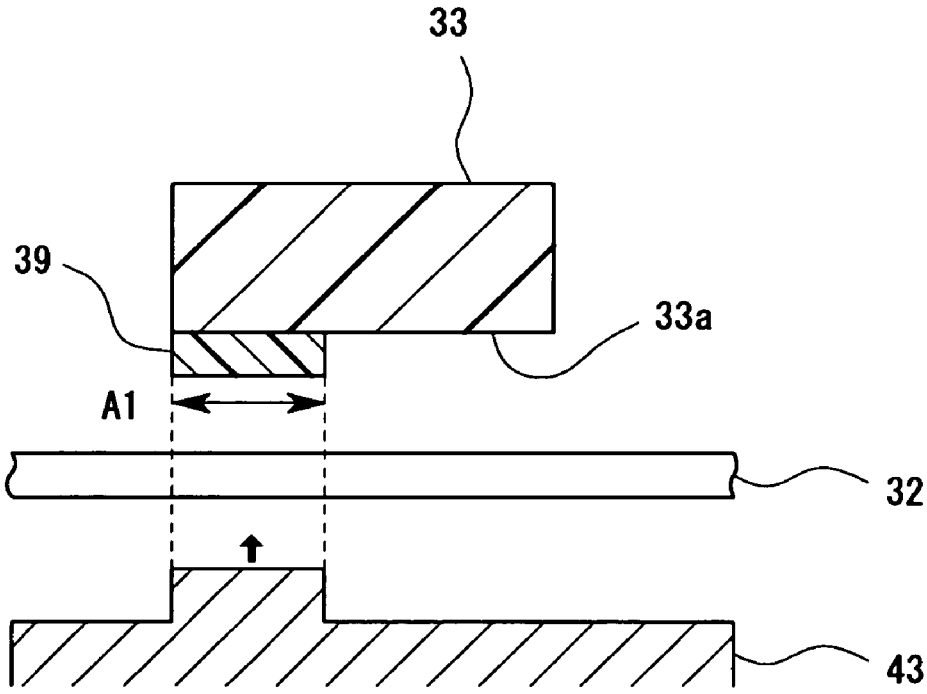
FIG. 6 is an illustrative view of one manufacturing step of the key sheet.
Figure 7:
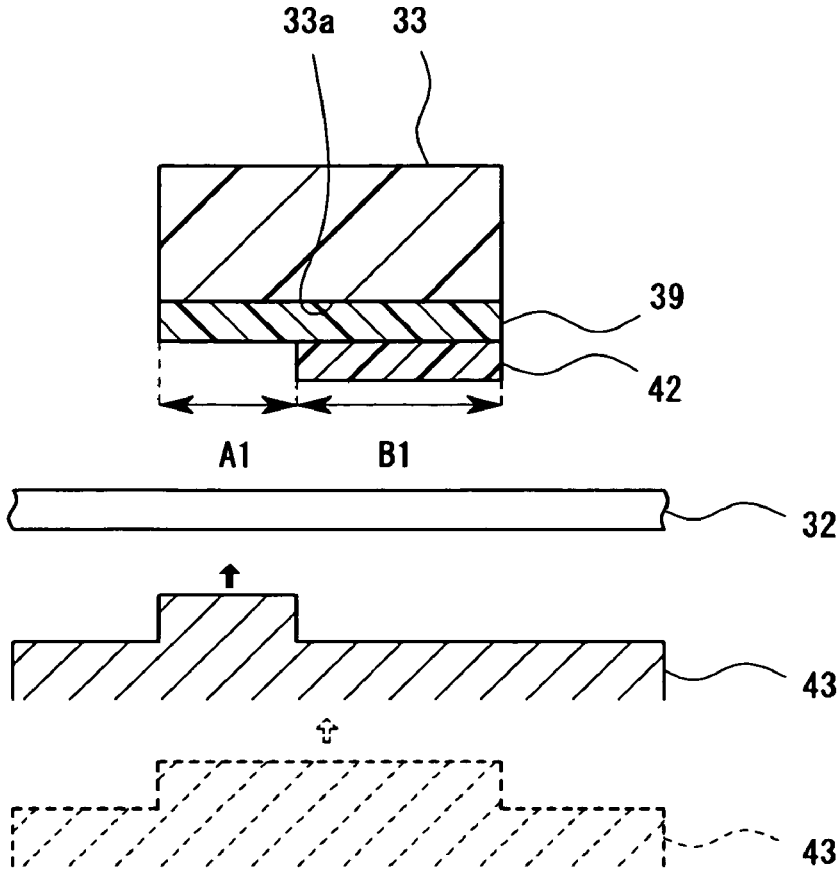
FIG. 7 is an illustrative view of one manufacturing step of the key sheet.

In steps from a step of printing the printed adhesive layer (39) to a step of fixing the printed adhesive layer (39), in order to fix the key tops (33) to the base sheet (32) at desired positions, the following various kinds of methods can be used. For example, in order to fix parts of the bottom surfaces (33*a*) of the key tops (33) to the base sheet (32), a method as shown in FIG. 5, where the printed adhesive layers (39) are formed on the entire bottom surfaces (33*a*) of the key tops (33), and, after that, only at predetermined regions (A1), the key tops (33) and the base sheet (32) are fixed by heating and pressing only the predetermined regions (A1) by a heat pressing machine (43), a method as shown in FIG. 6, where the printed adhesive layers (39) are formed only on regions (A1) to be adhered preliminarily of the entire bottom surfaces (33*a*) of the key tops (33), and a method as shown in FIG. 7, where, after the printed adhesive layers (39) are formed on the entire bottom surfaces (33*a*) of the key tops (33), masking layers (42) are formed on regions (B1) to be not fixed to the base sheet (32) by means of printing, and then, only at the parts of the regions (A1), the key tops (33) and the base sheet (32) are fixed each other by heating and pressing only the entire bottom surfaces (33*a*) of the key tops (33) or the regions (A1) on which the masking layers (42) are not formed, are included. In addition, it is also preferable to form the masking layers (42) by means of printing, and it is preferable to use an ink obtained from a material that hardly adheres to the base sheet (32) and a material that has a high softening temperature.

Figure 8:
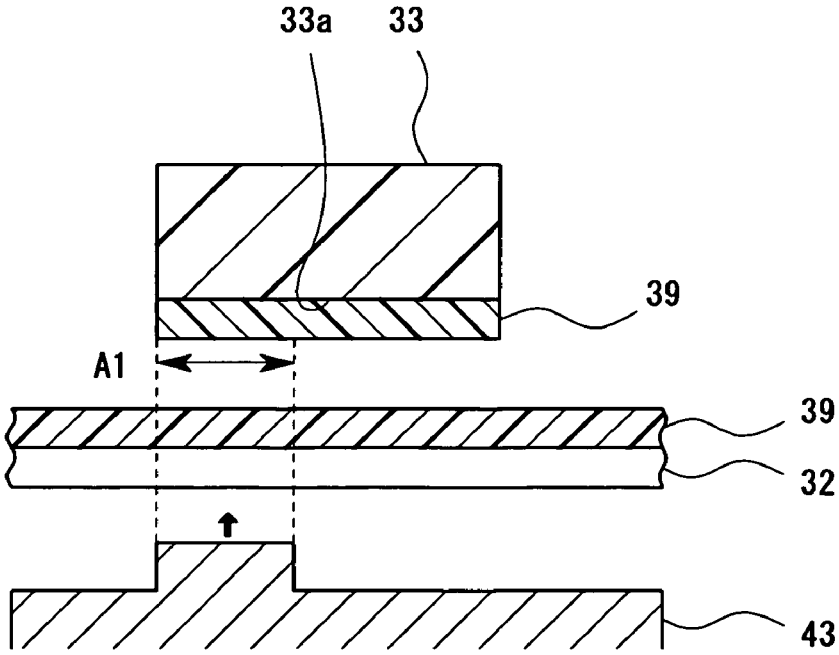
FIG. 8 is an illustrative view of one manufacturing step of the key sheet.
Figure 9:
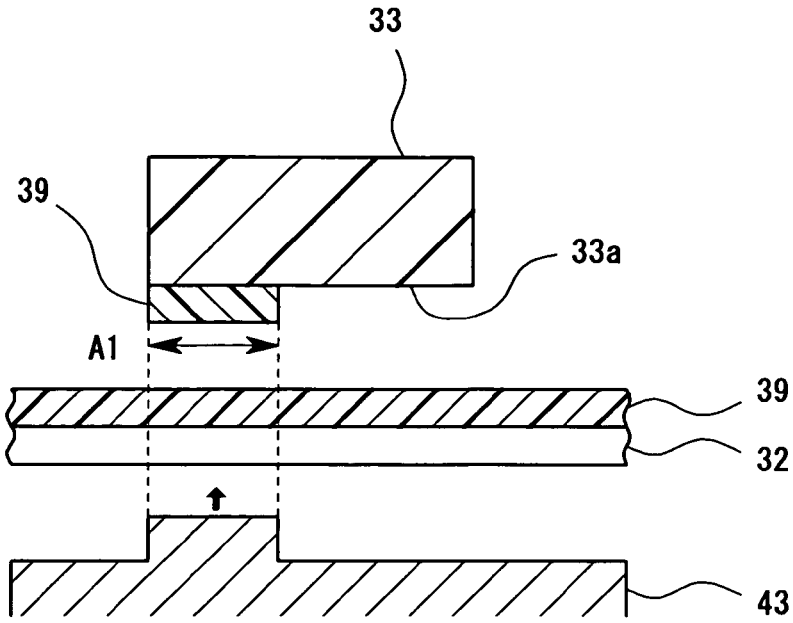
FIG. 9 is an illustrative view of one manufacturing step of the key sheet.
Figure 10:
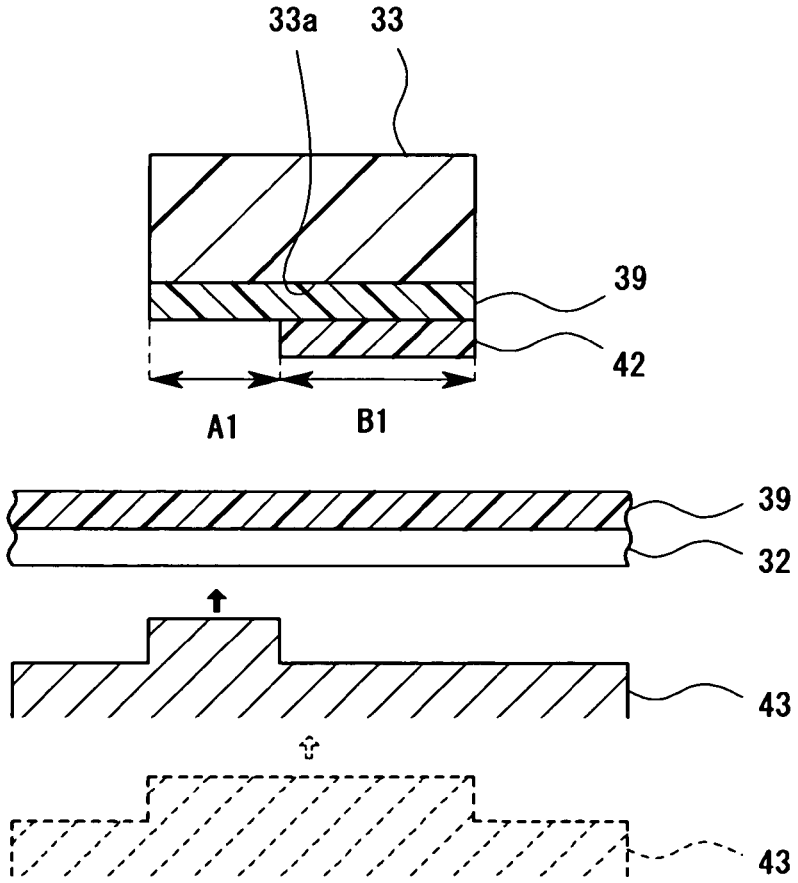
FIG. 10 is an illustrative view of one manufacturing step of the key sheet.
Figure 11:
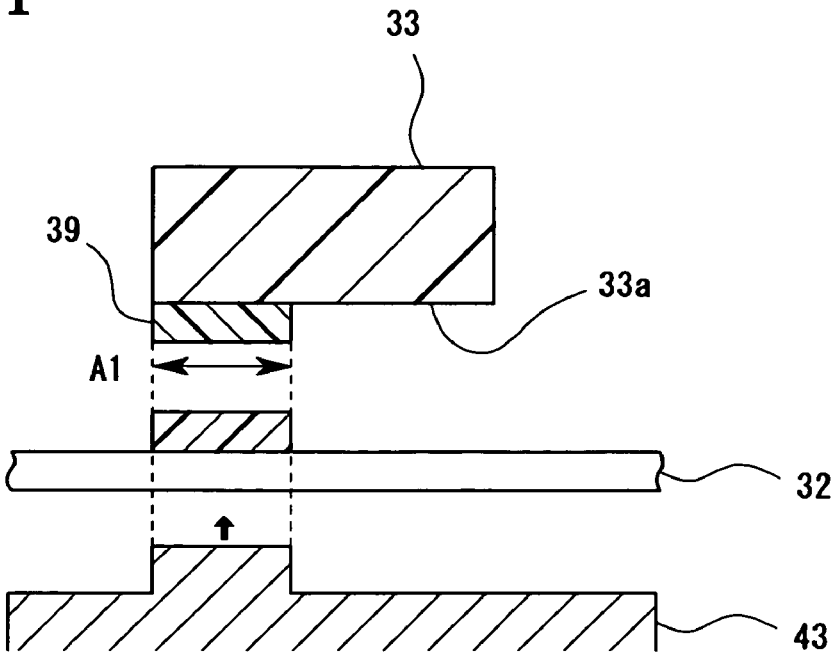
FIG. 11 is an illustrative view of one manufacturing step of the key sheet.
Figure 12:
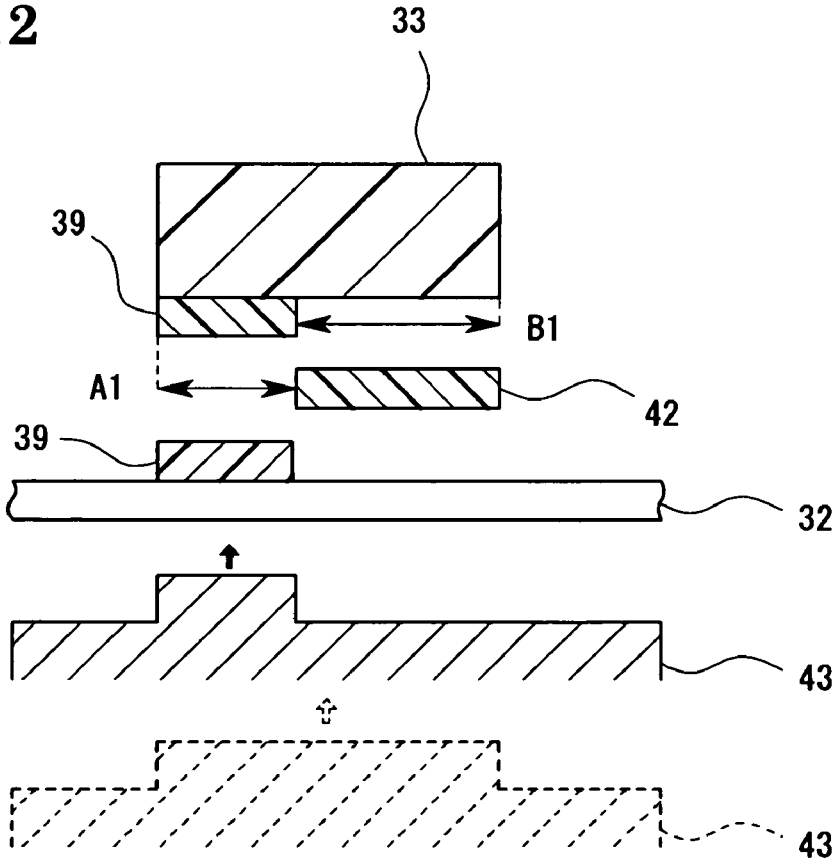
FIG. 12 is an illustrative view of one manufacturing step of the key sheet.

Moreover, in these examples, although, the printed adhesive layers (39) are formed only on the bottom surfaces (33*a*) of the key tops (33), it is also possible to use a method where the printed adhesive layers (39) are provided to the sides of the base sheet (32). As for the examples shown in FIGS. 8 to 10, they are methods where, in addition to each case shown in FIGS. 5 to 7, the printed adhesive layers (39) are further provided to the base sheet (32). Since, in some kinds of the base sheet (32), the key tops (33) hardly fixed to the base sheet (32) only by providing the printed adhesive layers (39) on the key tops (33), by providing the printed adhesive layers (39) on the base sheet (32) preliminarily, it is possible to enhance the adhesive strength between the key tops (33) and the base sheet (32). As further another method, a method as an example shown in FIG. 11, where the printed adhesive layer (39) is not provided on the entire surface of the base sheet (32), rather, the printed adhesive layers (39) are provided only on predetermined parts of the base sheet (32), can also be used. Moreover, as shown in FIG. 12, the masking layers (42) may be provided. Moreover, though being not shown, it is also possible to provide the printed adhesive layer (39) to the side of the base sheet (32) without providing the printed adhesive layers (39) to the sides of the key tops (33).

Meanwhile, in order to fix the entire bottom surfaces (33*a*) of the key tops (33) to the base sheet (32), it can be performed by providing the printed adhesive layers (39) to the entire bottom surfaces (33*a*) of the key tops (33), and then heating and pressing the entire surfaces, or by providing the printed adhesive layers (39) to the predetermined surfaces of the base sheet (32) preliminarily, and then heating and pressing the part corresponding to the key tops (33) and the entire surface of the base sheet (32).

The conditions of performing heating and pressing, although depends on a material used as the printed adhesive layers (39), the thicknesses of the printed adhesive layers (39), and the thickness of the base sheet (32), the surface temperature of the parts to be pressed is 120° C. to 220° C., more preferably, 140° C. to 170° C., and the pressing time is one second to 20 seconds, more preferably, five seconds to ten seconds, and the pressure is 30 kg/(20-25 $cm^2$) to 500 kg/(20-25 $cm^2$), more preferably, 50 kg/(20-25 $cm^2$) to 300 kg/(20-25 $cm^2$).

As above, the methods of fixing between the key tops (33) and the base sheet (32), are described, the fixing between the frame sheet (38) and the base sheet (32) can be also performed in a similar manner. Moreover, as for heating and pressing, heating is caused to be performed from the side of the base sheet (32), however, it is also possible to perform heating from the side of the key tops (33).

Next, the action and the effect of the key sheet (31) thus obtained, will be described.

Figure 13A:
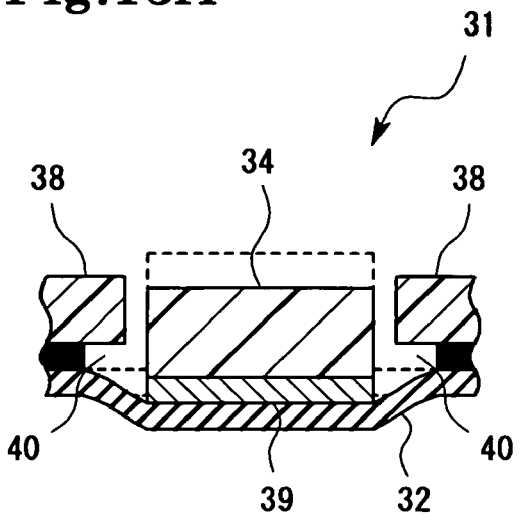
FIG. 13A and FIG. 13B are cross sectional schematic views showing a different flexible state of the base sheet by the presence or non-presence of the gap parts.
Figure 13B:
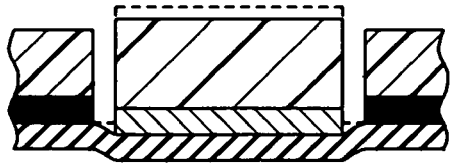

As shown in FIG. 3, the entire bottom surfaces (34*a*) of the medium size key tops (34) are fixed to the base sheet (32) via the printed adhesive layers (39), resulting in no gap between the medium size key tops (34) and the base sheet (32). Consequently, the corners of the medium size key tops (34) are hardly hooked by the nail tip, and the medium size key tops (34) hardly come off from the key sheet (31). Meanwhile, at the outer edges (38*a*) of the frame sheet (38), neighboring the medium size key tops (34), the frame sheet (38) and the base sheet (32) are not fixed each other, resulting in gap parts (40). Therefore, as shown in FIG. 13A, in a key sheet (31) having the gap parts (40), the downward stroke during pressing operation can be caused to be longer, enabling the required pressing operation. Consequently, it is possible to perform a correct switch input. Meanwhile, in a key sheet with no gap, provided for comparison and shown in FIG. 13B, it is not possible to cause the downward pressing stroke to be longer. In addition, even if nail or the like enters in the gap parts (40) of the frame sheet (38), since the frame sheet (38) is fixed to the base sheet (32) on its wide area, the possibility of peeling and coming off of the frame sheet (38) is none.

Moreover, as shown in FIG. 4, similar to the medium size key tops (34), the entire bottom surface (35*a*) of the center key top (35) is fixed to the base sheet (32) via the printed adhesive layer (39), resulting in no gap between the center key top (35) and the base sheet (32). Meanwhile, at the outer edges (36*a*) of the ring key top (36), neighboring the center key top (35), the ring key top (36) and the base sheet (32) are not fixed each other, resulting in gap parts (40). Consequently, it is possible for the center key top (35) to perform a required pushing operation, enabling performing a correct switch input.

Especially, when, as compared the thickness of the base sheet (32) to that of the frame sheet (38), the base sheet (32) is formed by a film thinner than that of the frame sheet (38), the base sheet (32) becomes flexible by the pushing operation of the key tops (33), thereby, it is possible to cause the base sheet (32) to have a function enabling input operation by a light input load, and the thick film sheet (38) to have a function to keep the entire formability of the key sheet (31). Moreover, since the key tops (33) are thin, and the base sheet (32) is also formed by a thin resin film, it is possible to cause the film thickness of the entire key sheet (31) to be as thin as an order of 0.5 mm to 1 mm. Moreover, since a rubber-like elastic body is not used, rather a resin film is used, the key sheet (31) has given rigidity, thereby, even if, like a mobile-phone (3), a large operation opening (3*a*) is provided, the key sheet (31) hardly bends. Consequently, problems that occur if the key sheet is bent, for example, an operational trouble due to the displacement between the key tops and the contact switch, degradation of operability due to the difference of amount of pushing stroke in every key tops, adverse affect on designability of equipment, submarining of the key tops, and the like, hardly occurs.

In the present embodiment, both of the adhesion between the key tops (33) and the base sheet (32) and the adhesion between the frame sheet (38) and the base sheet (32), are caused to be printed adhesive layers that are provided by printing a solvent-diluted ink made of a material that softens or melts by being heated, however, an adhesive layers formed between the ring key top (36) and the base sheet (32), or an adhesive layer formed between the frame sheet (38) and the base sheet (32) may be provided by means of a method other than printing, and a simple adhesive layer formed by means of coating of an UV curing adhesive or an instant adhesive may be used.

As a modification of the above-mentioned embodiment, it is possible to modify the shapes, sizes, numbers, manner of arrangement, and the like of the key tops, depending on a required design or the type of the equipment.

Moreover, in the present invention, the key sheet was caused to be a key sheet (31) used in a mobile-phone (3), however, the key sheet can be caused to be a key sheet that is used in an operating part of equipment other than the mobile-phone (3), for example, a PDA, a car navigation system, a car audio system.

EXAMPLES

Next, based on the following examples, the present invention will be further described. A key sheet (31) that had medium size key tops (34) (vertical×horizontal=5 mm×10 mm) and a shape (vertical×horizontal=70 mm×45 mm) shown in FIG. 2, having a distance of 2 mm of frames between the medium size key tops, was manufactured using a various kinds of materials.

Example 1 (Samples 1 to 4)

Figure 14:
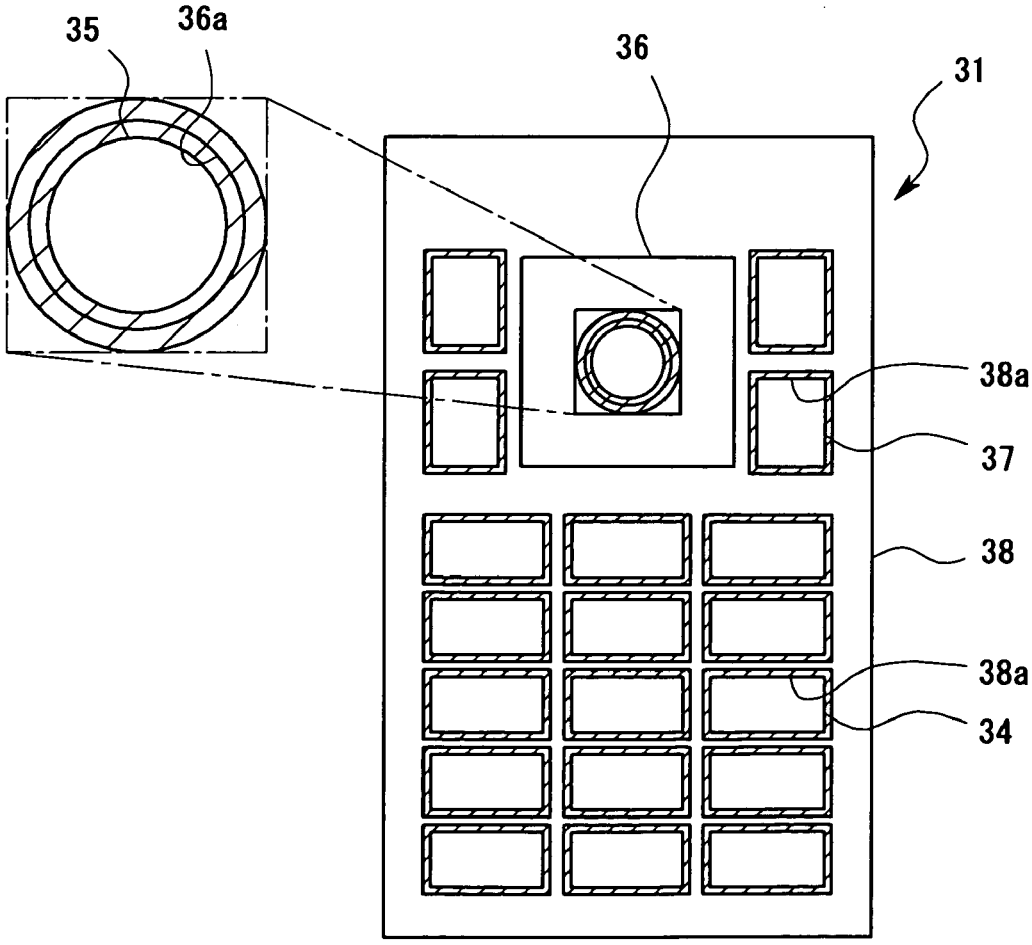
FIG. 14 is a plane view showing the presence or non-presence of an adhesive layer.
Figure 15:
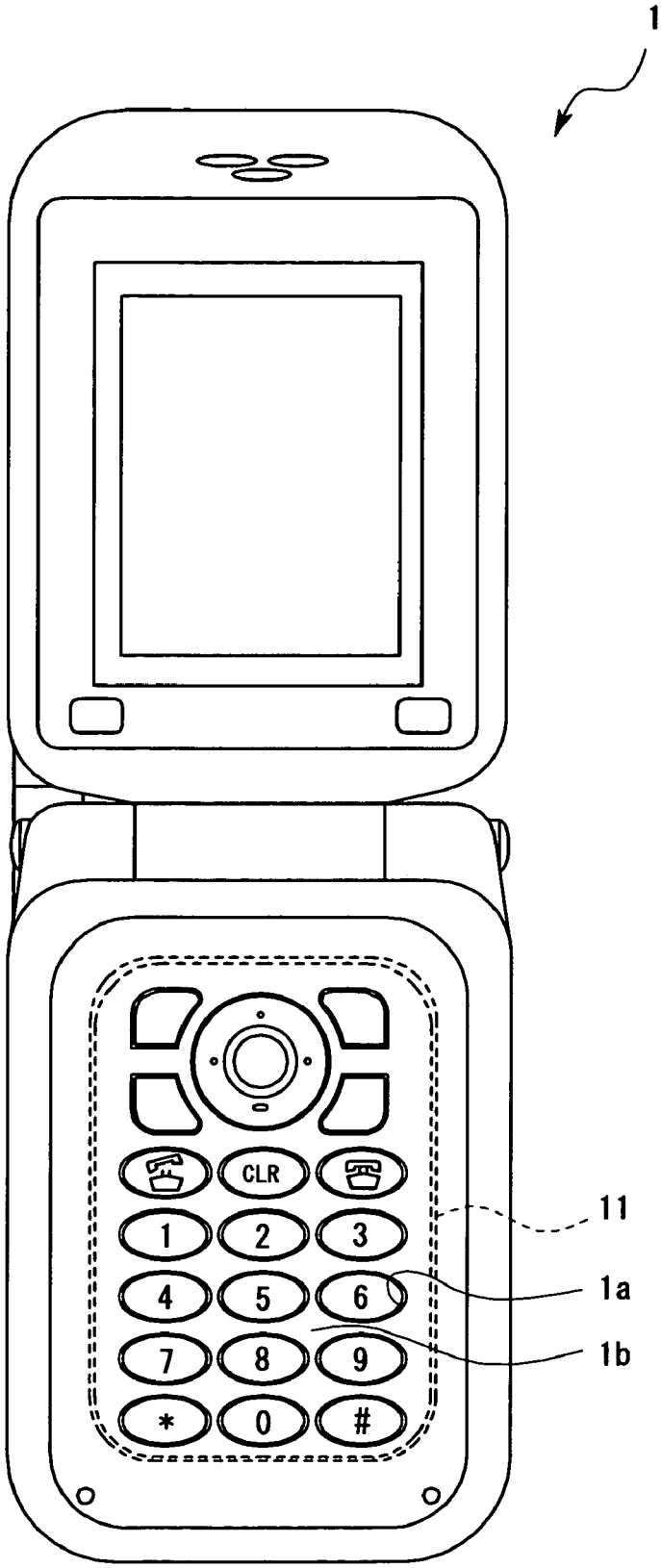
Fig.15 Related Art
FIG. 15 is a schematic view of a mobile-phone on which a prior art key sheet shown in FIG. 16 is mounted.
Figure 16:
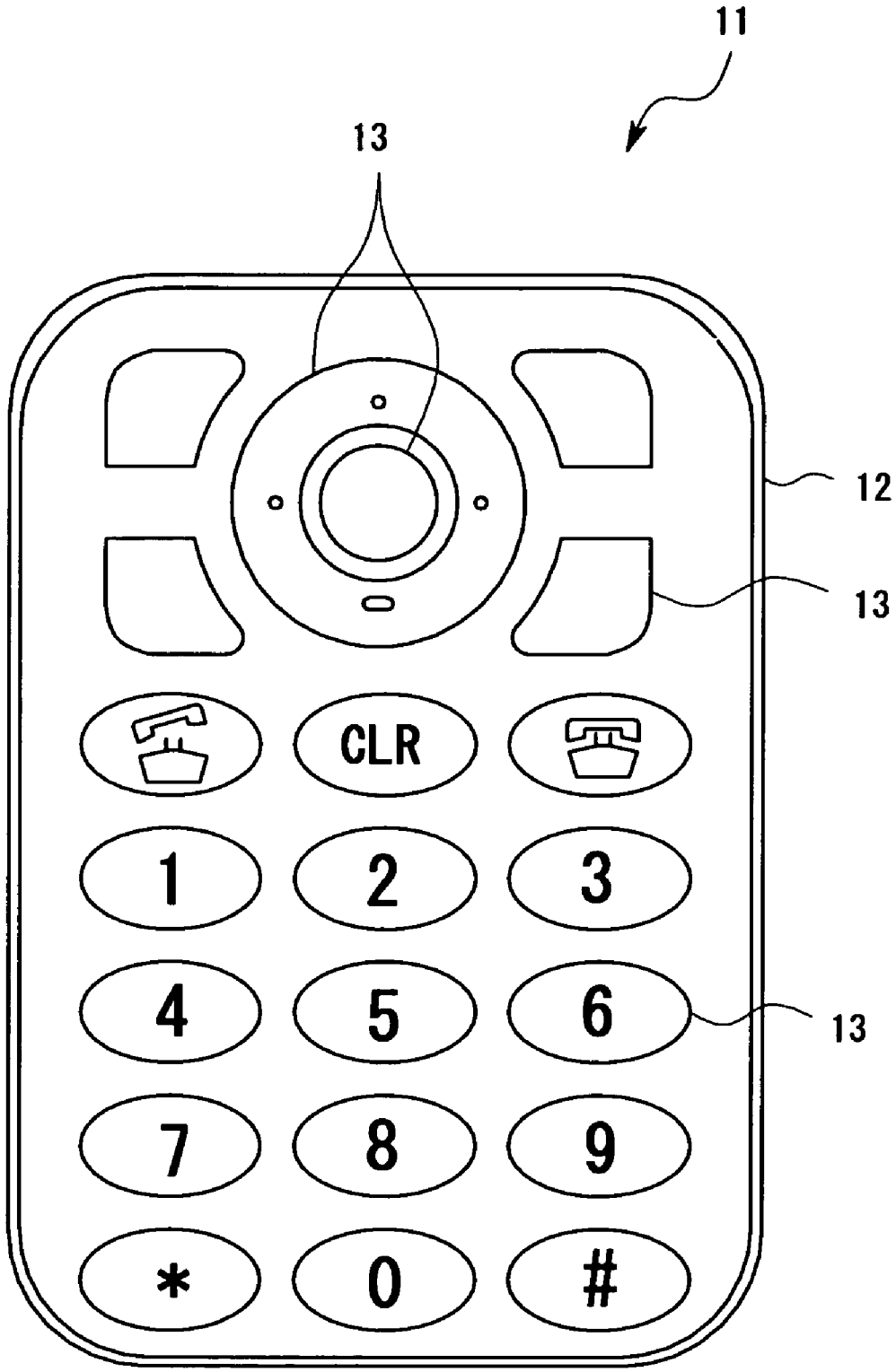
Fig.16 Related Art
FIG. 16 is a plane view of the prior art key sheet.
Figure 17:
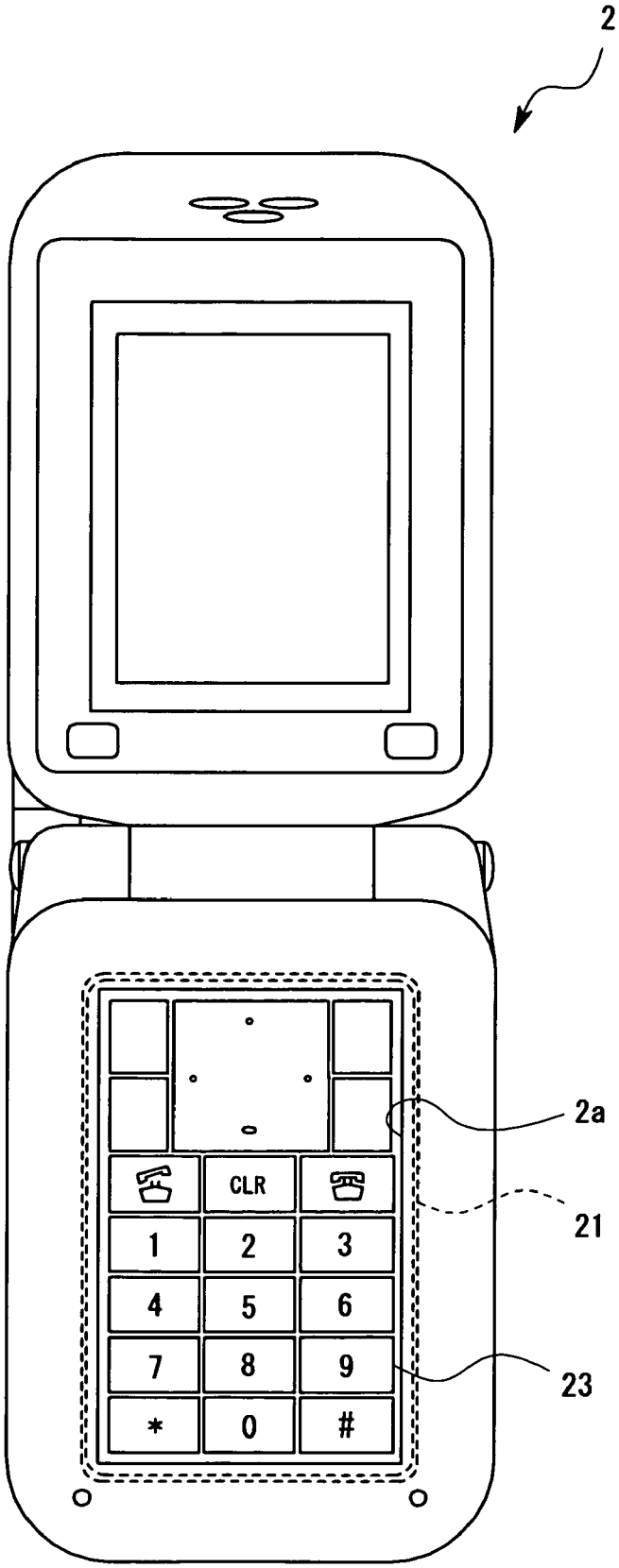
Fig.17 Related Art
FIG. 17 is a schematic view of a mobile-phone on which another prior art key sheet shown in FIG. 18, is mounted.
Figure 18:
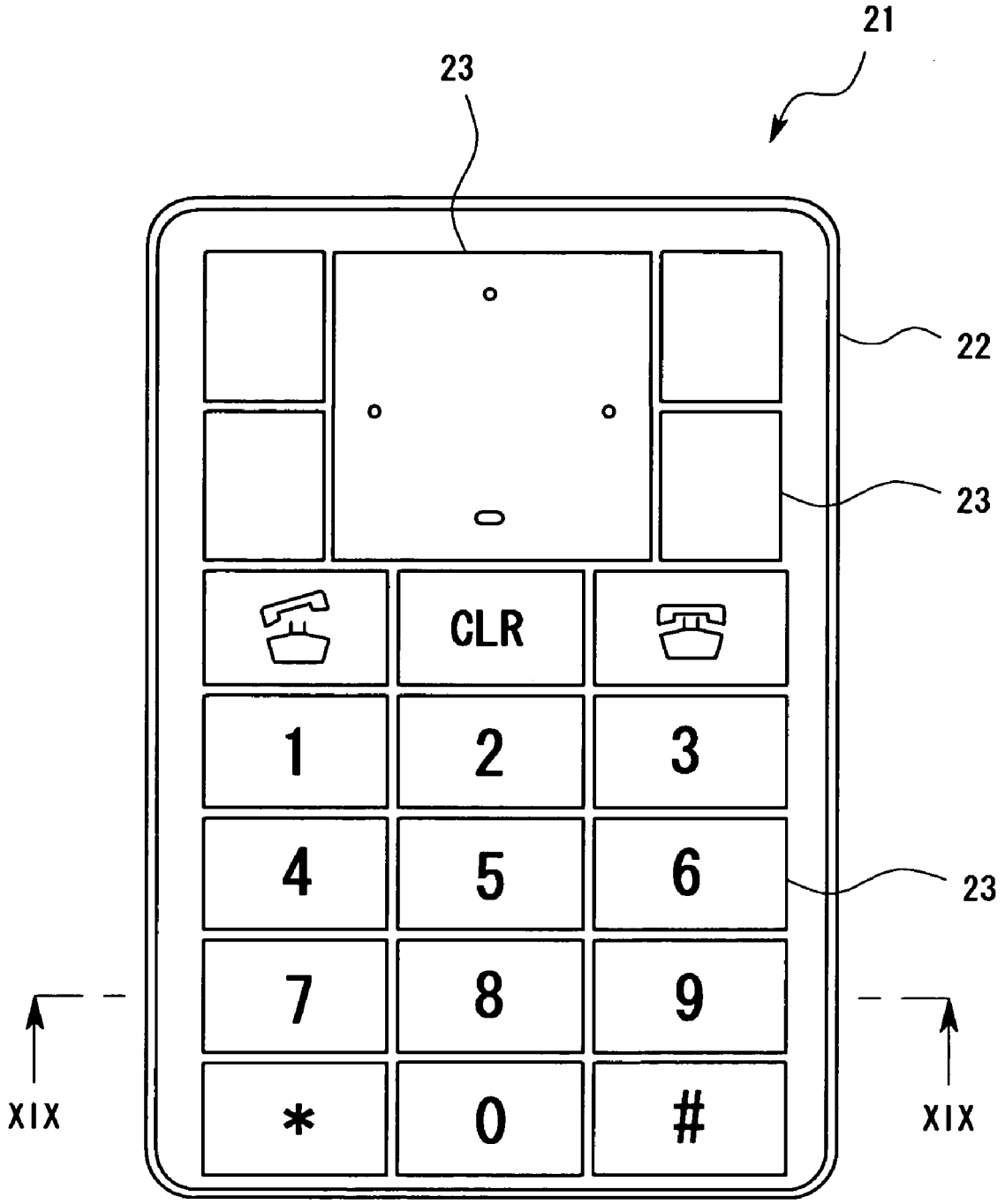
Fig.18 Related Art
FIG. 18 is a plane view of another prior art key sheet.
Figure 19:
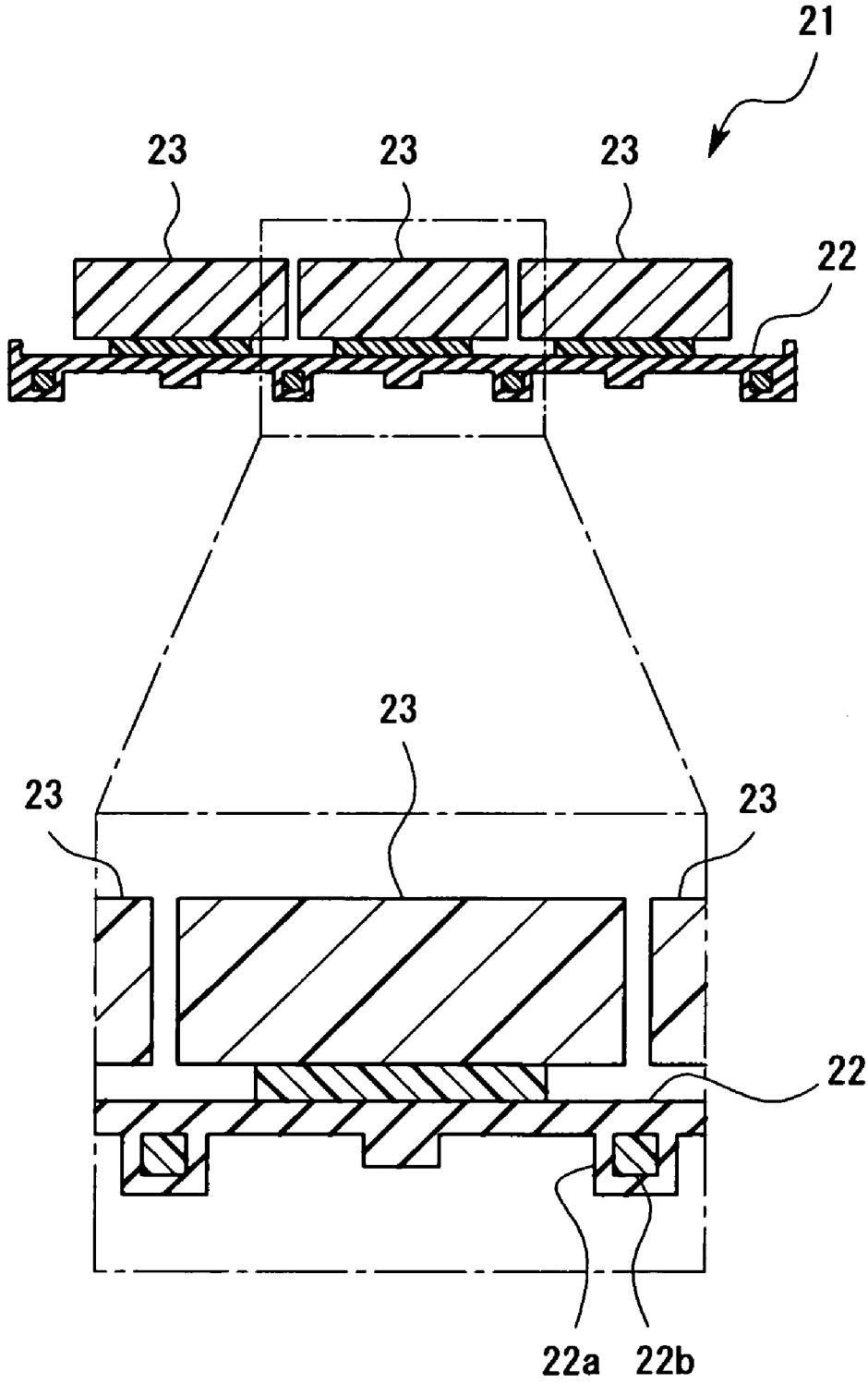
Fig.19 Related Art
FIG. 19 is a sectional view of XIX-XIX line of the key sheet shown in FIG. 18.

First, medium size key tops (34), a center key top (35), a ring key top (36), longitudinal key tops (37), were formed, respectively, using a polycarbonate resin, a frame sheet (38) was formed using a PET film with a thickness of 0.3 mm, and a base sheet (32) was formed using materials shown in the following Table 1. Next, using inks for printed adhesive layers (39) shown in Table 1, the printed adhesive layers (39) were formed on the bottom surfaces (33*a*) of each key tops (33) by means of screen printing. Here, on the entire bottom surfaces (34*a*, 35*a*) of the medium size key tops (34) and the center key top (35), the printed adhesive layers (39) were formed. Moreover, on the entire bottom surface (36*b*) of the ring key top (36), except for the part from the periphery to 0.5 mm inner from the periphery of the ring key top (36), of the outer edge (36*a*) at the side neighboring the center key top (35), the printed adhesive layer (39) was formed. Further, on the entire bottom surface (38*b*) of the frame sheet (38), except for the parts from the periphery to 0.5 mm inner from the frame sheet (38), of the outer edges (38*a*) at the side neighboring the medium size key tops (34), the printed adhesive layer (39) was formed. The parts on which the printed adhesive layer (9) was not formed, were shown in FIG. 14, using diagonal lines. After that, after being positioned, the various kinds of key tops (33), the frame sheet (38), and the base sheet (32) were heated and pressed on the entire bottom surface of the base sheet (32) from the side of the base sheet (32), using a thermo-compression machine ("UP-DOWN press" trade name: made by NAVITAS CO.LTD.) as a heat pressing machine (43). As for the heating conditions, the preset temperature of the machine was set to 180° C. to 220° C., and the surface temperature of a rubber push plate being directly brought into contact with the base sheet (32) was set to 140° C. to 170° C. The pressing force was set to 100 kg to 200 kg per a sheet, and the pressing time was set to five seconds to ten seconds. Then, key sheets (31) indicated by samples 1 to 4, where only the parts on which the printed adhesive layer (39) was provided, were fixed, were obtained.

TABLE 1

| | Base Sheet Type Thickness | Adhesive Layer (Key Top Side) Type Thickness | Masking Layer Type Thickness | Method of Pressure Bonding |
|---|---|---|---|---|
| Sample 1 | Base Sheet A#1 PET 12 μm | Adhesive Layer A Thermoplastic Ink 5 μm | None | Entire Bottom Surface of the Base Sheet was pressure bonded |
| Sample 2 | Base Sheet B Nylon 30 μm | Adhesive Layer B Thermoplastic Ink 3 μm | None | Same as above |
| Sample 3 | Base Sheet C Urethane 50 μm | Adhesive Layer C Thermoplastic Ink 10 μm | None | Same as above |

TABLE 1-continued

| | Base Sheet Type Thickness | Adhesive Layer (Key Top Side) Type Thickness | Masking Layer Type Thickness | Method of Pressure Bonding |
|---|---|---|---|---|
| Sample 4 | Base Sheet D#2 OPP 20 μm | Adhesive Layer D Thermoplastic Ink 5 μm | None | Same as above |

In Table 1, the base sheet A is 12 μm thick "S 10" (trade name) made by TORAY Corp. on which a polyester resin ("BYLON 300" (trade name) made by TOYOBO CO., LTD.) is coated with a thickness of 3 μm, the base sheet B is "DAIAMID 4100" (trade name) made by DAICEL CHEMICAL INDUSTRIES, LTD., and the base sheet C is "DUS 202" (trade name) made by Sheedom Co. Ltd. Moreover, the base sheet D is 20 μm thick biaxially-oriented polypropylene, "V-OP" (trade name) made by Tohcello Co Ltd., whose surface is subjected to k-coating treatment (vinylidene chloride coating treatment). Additionally, #-mark appended to the base sheets A and D in the table indicates that these sheets are subjected to a surface treatment in the above-mentioned manner. Additionally, as for the physical properties of each sheet, the base sheet A had pulling strength of 2200 kg/cm$^2$, elongation of 150%, pulling elastic modulus of 430 kg/mm$^2$, based on JIS-K7127, the base sheet B had pulling strength of 450 kg/cm$^2$, elongation of 350%, pulling elastic modulus of 20 kg/mm$^2$, based on ASTMD882-64T, the base sheet C had pulling strength of 450 kg/cm$^2$, elongation of 550%, pulling elastic modulus of 80 kg/mm$^2$, based on JIS-K7311, and the base sheet D had pulling strength of 1900 kg/cm$^2$, elongation of 100%, pulling elastic modulus of 200 kg/mm$^2$, based on JIS-K7127.

Moreover, in Table 1, the adhesive layer A used "CAV Transparent series" (trade name) made by Seiko advance Ltd., the adhesive layer B used "JT94" (trade name) made by Seiko advance Ltd., the adhesive layer C used "SG740" (trade name) made by Seiko advance Ltd. (base resin of 100 is blended with a cure agent of 5), and the adhesive layer D used "JT20" (trade name) made by Seiko advance Ltd., as respective printing inks. Here, thickness indicates the thickness of a solid content after being printed, that is the thickness of the printed adhesive layer (39).

Example 2 (Samples 5 to 8)

Although, in example 1, the printed adhesive layer (39) was provided on a part of the bottom surface of the ring key tops (36) and the frame sheet (38), here, instead, the printed adhesive layer (39) was printed on the entire bottom surface of the ring key top (36) and the frame sheet (38). After that, the inks shown in Table 1 were printed on the parts on which an ink for the printed adhesive layer (39) was not coated, that are the parts from a predetermined periphery of each key tops (36) and each frame sheet (38) to parts inner from the predetermined periphery, to form masking layers (42). Conditions other than above were set to similar to those of example 1, and key sheets (31) indicated by samples 5 to 8 were obtained.

TABLE 2

| | Base Sheet Type Thickness | Adhesive Layer (Key Top Side) Type Thickness | Masking Layer Type Thickness | Method of Pressure Bonding |
|---|---|---|---|---|
| Sample 5 | Base Sheet A#1 PET 12 μm | Adhesive Layer A Thermoplastic Ink 5 μm | Masking Layer A UV Ink 5 μm | Entire Bottom Surface of the Base Sheet was pressure bonded |
| Sample 6 | Base Sheet B Nylon 30 μm | Adhesive Layer B Thermoplastic Ink 3 μm | Masking Layer B Thermoplastic Ink 5 μm | Same as above |
| Sample 7 | Base Sheet C Urethane 50 μm | Adhesive Layer C Thermoplastic Ink 10 μm | Masking Layer C Thermoplastic Ink 10 μm | Same as above |
| Sample 8 | Base Sheet D#2 OPP 20 μm | Adhesive Layer D Thermoplastic Ink 5 μm | Masking Layer D UV Ink 10 μm | Same as above |

In table 2, the base sheets A to D, and the adhesive layers A to D, are the same as those of in table 1. Moreover, the masking layer A is "PP4900" (trade mark) made by JUJO CHEMICAL CO. LTD., the masking layer B is "HAC" (trade mark) made by Seiko advance Ltd., the masking layer C is "SP700" (trade mark) made by JUJO CHEMICAL CO. LTD., and the masking layer D is "PP4900" (trade mark) made by JUJO CHEMICAL CO. LTD.

Example 3 (Samples 9 to 16)

Although, in examples 1 and 2, the entire bottom surface of the base sheet (32) was heated and pressed from the side of the base sheet (32), by a thermo-compression machine, here, instead, only parts corresponding to the parts on which the printed adhesive layers (39) were provided in example 1, were heated and pressed. In this manner, key sheets (31) indicated by samples 9 to 19 respectively using the same raw materials and configurations as those of samples 1 to 8 of examples 1 and 2, were produced.

TABLE 3

| | Base Sheet Type Thickness | Adhesive Layer (Key Top Side) Type Thickness | Masking Layer Type Thickness | Method of Pressure Bonding |
|---|---|---|---|---|
| Sample 9 | Base Sheet A#1 PET | Adhesive Layer A Thermoplastic Ink | None | Entire Bottom Surface of the |

TABLE 3-continued

| | Base Sheet Type Thickness | Adhesive Layer (Key Top Side) Type Thickness | Masking Layer Type Thickness | Method of Pressure Bonding |
|---|---|---|---|---|
| | 12 μm | 5 μm | | Base Sheet was pressure bonded |
| Sample 10 | Base Sheet B Nylon 30 μm | Adhesive Layer B Thermoplastic Ink 3 μm | None | Same as above |
| Sample 11 | Base Sheet C Urethane 50 μm | Adhesive Layer C Thermoplastic Ink 10 μm | None | Same as above |
| Sample 12 | Base Sheet D#2 OPP 20 μm | Adhesive Layer D Thermoplastic Ink 5 μm | None | Same as above |

TABLE 4

| | Base Sheet Type Thickness | Adhesive Layer (Key Top Side) Type Thickness | Masking Layer Type Thickness | Method of Pressure Bonding |
|---|---|---|---|---|
| Sample 13 | Base Sheet A#1 PET 12 μm | Adhesive Layer A Thermoplastic Ink 5 μm | Masking Layer A UV Ink 5 μm | Entire Bottom Surface of the Base Sheet was pressure bonded |
| Sample 14 | Base Sheet B Nylon 30 μm | Adhesive Layer B Thermoplastic Ink 3 μm | Masking Layer B Thermoplastic Ink 5 μm | Same as above |
| Sample 15 | Base Sheet C Urethane 50 μm | Adhesive Layer C Thermoplastic Ink 10 μm | Masking Layer C Thermoplastic Ink 10 μm | Same as above |
| Sample 16 | Base Sheet D#2 OPP 20 μm | Adhesive Layer D Thermoplastic Ink 5 μm | Masking Layer D UV Ink 10 μm | Same as above |

In Tables 3 and 4, the base sheets A to D, the adhesive layers A to D, and the masking layers A to D, are same as those indicated in Tables 1 and 2.

Example 4 (Samples 17 to 20)

Although, in example 1, in order to fix the ring key top (36) and frame sheet (38) to the base sheet (32), the printed adhesive layer (39) described in Table 1 was also used, here, instead, as for the adhesion of the ring key top (36) and frame sheet (38) to the base sheet (32), an UV curing adhesive was used. In other words, after key tops (33) except for the ring key top (36) and the frame sheet (38) were fixed to the base sheet (32) in a similar manner as in example 1, by dropping an UV curing adhesive on suitable positions of the ring key top (36) and the frame sheet (38), these members were adhered to the base sheet (32) on which key tops (33) except for the ring key top (36) were fixed, and then the UV curing adhesive was cured. Otherwise, in a similar manner in example 1, key sheets (31) indicated by samples 17 to 20 were obtained.

Any one of key sheets (31) indicated by samples 1 to 20 has suitable rigidity, and, thereby, can perform a switching operation with no trouble when mounted on a mobile-phone (3).

The descriptions of the present invention should not be understood in a limiting manner. The advantages, features, and applications of the present invention, will be more clear by the following descriptions by referring to the drawings. Further, all the suitable modifications that does not change the gist of the present invention are intended to be included within the scope of the present invention. Though various embodiments of the present invention will be described, they should be understood to be appeared only as examples, and to be not limited. As above, the scope of the present invention should not be limited to the embodiments exemplified above.

What is claimed is:

1. A key sheet, comprising:

a base sheet made of a resin film;

key tops to be arranged on the base sheet; and printed adhesive layers for the key tops, made of cured bodies which are formed on either of the key tops or the base sheet as printed layers, and brought into contact with the key tops and the base sheet in a softened or molten state.

2. The key sheet according to the claim 1, further comprising a frame sheet to be arranged on the base sheet together with the key tops.

3. The key sheet according to the claim 2, further comprising an adhesive layer for fixing the frame sheet and the base sheet, wherein, the printed adhesive layers for the key tops are formed on the entire bottom surfaces of the key tops; and the adhesive layer of the frame sheet is formed on a bottom surface of the frame sheet except for outer edge sides neighboring the key tops.

4. The key sheet according to claim 2, wherein adhesive layers of a frame sheet are the printed adhesive layers made of cured bodies that are formed on either of the frame sheet or the base sheet as printed layers, and brought into contact with the frame sheet and the base sheet in a softened or molten state.

5. The key sheet according to claim 2, wherein a flush operational surface on which the key tops and a frame sheet substantially continue, is formed.

6. The key sheet according to claim 1, further comprising:

neighboring key tops to be arranged on the base sheet together with the key tops; and adhesive layers for fixing the neighboring key tops and the base sheet;

wherein, the printed adhesive layers for the key tops are formed on the entire bottom surfaces of the key tops; and the adhesive layers for the neighboring key tops are formed on the bottom surfaces of the neighboring key tops except for outer edge sides neighboring the key tops.

7. The key sheet according to claim 6, wherein the adhesive layers of the neighboring key tops are printed adhesive layers made of cured bodies that are formed on either of the neighboring key tops or the base sheet as printed layers, and brought into contact with the neighboring key tops and the base sheet in a softened or molten state.

8. The key sheet according to claim 6, wherein a flush operational surface on which the key tops and the neighboring key tops substantially continue, is formed.

9. A key sheet, comprising:

a base sheet made of a resin film;

key tops to be arranged on the base sheet; and printed adhesive layers for the key tops for fixing the base sheet and the key tops by forming sides substantially flush with the sides of the key tops, between the base sheet and the key tops, wherein the printed adhesive layers are into contact with the key tops and the base sheet in a softened or molten state.

10. The key sheet according to claim 9, comprising a frame sheet to be arranged on the base sheet together with the key tops.

11. The key sheet according to claim 10, further comprising an adhesive layer for fixing the frame sheet and the base sheet, wherein, the printed adhesive layers for the key tops are formed on the entire bottom surfaces of the key tops; and the adhesive layer for the frame sheet is formed on a bottom surface of the frame sheet except for outer edge sides neighboring the key tops.

12. The key sheet according to claim 10, wherein the adhesive layers of the frame sheet are printed adhesive layers.

13. The key sheet according to claim 10, wherein a flush operational surface on which the key tops and the frame sheet substantially continue, is formed.

14. The key sheet according to claim 9, further comprising:

a frame sheet arranged in substantially the same horizontal plane as the key tops, each on the base sheet.

15. A key sheet, comprising:

a base sheet made of a resin film;

key tops to be arranged on the base sheet;

printed adhesive layers for the key tops for fixing the base sheet and the key tops by forming sides substantially flush with the sides of the key tops, between the base sheet and the key tops; and neighboring key tops to be arranged on the base sheet together with the key tops; and adhesive layers for fixing the neighboring key tops to the base sheet;

wherein, the printed adhesive layers for the key tops are formed on the entire bottom surfaces of the key tops; and the adhesive layers for the neighboring key tops are formed on the bottom surfaces of the neighboring key tops except for the outer edge sides neighboring the key tops.

16. The key sheet according to claim 15, wherein the adhesive layers of the neighboring key tops are printed adhesive layers.

17. The key sheet according to claim 15, wherein a flush operational surface on which the key tops and the neighboring key tops substantially continue, is formed.

18. A manufacturing method for a key sheet where a base sheet and key tops to be arranged on the base sheet are fixed by adhesive layers, wherein, the key tops are fixed to the base sheet by forming printed adhesive layers for the key tops, on facing surfaces of at least either of the key tops or the base sheet, then by bringing the printed adhesive layers into contact with the other facing surfaces in a softened or molten state, and by curing the printed adhesive layers.

19. The manufacturing method for a key sheet according to claim 18, wherein entire surfaces or parts of the printed adhesive layers of key tops are heated.

20. The manufacturing method for a key sheet according to claim 18, wherein, in the printing step of forming the printed adhesive layers, a solvent-diluted ink is used.

21. A manufacturing method for a key sheet including a base sheet, key tops to be arranged on the base sheet, and a frame sheet to be arranged on the base sheet together with the key tops, wherein the key tops are fixed to the base sheet, by forming printed adhesive layers on entire facing surfaces of at least either of the key tops or the base sheet, by bringing the printed adhesive layers into contact with the other facing surfaces in a softened or molten state, and by curing the printed adhesive layers; and a bottom surface of the frame sheet, except for the outer edge sides neighboring the key tops, is fixed to the base sheet.

22. The manufacturing method for a key sheet according to claim 21, wherein entire surfaces or parts of the printed adhesive layers of the key tops, are heated.

23. The manufacturing method for a key sheet according to claim 21, wherein, in the printing step of the printed adhesive layers, a solvent-diluted ink is used.

24. A manufacturing method for a key sheet, including a base sheet, key tops to be arranged on the base sheet, and a neighboring key top to be arranged on the base sheet together with the key tops, wherein the key tops are fixed to the base sheet, by forming printed adhesive layers on at least entire facing surfaces of at least either of the key tops or the base sheet, then by bringing the printed adhesive layers into contact with the other facing surfaces in a softened or molten state, by curing the printed adhesive layers; and the bottom surfaces of the neighboring key tops, except for outer edge sides neighboring the key tops are fixed to the base sheet.

25. The manufacturing method for a key sheet according to claim 24, wherein entire surfaces or parts of the printed adhesive layers of the key tops, are heated.

26. The manufacturing method for a key sheet according to claim 24, wherein, in the printing step of the printed adhesive layers, a solvent-diluted ink is used.

* * * * *